US009915502B2

(12) United States Patent
Capson

(10) Patent No.: US 9,915,502 B2
(45) Date of Patent: Mar. 13, 2018

(54) BACKLIT SIGHTING DEVICE

(71) Applicant: Ronnie Rex Capson, Blackfoot, ID (US)

(72) Inventor: Ronnie Rex Capson, Blackfoot, ID (US)

( * ) Notice: Subject to any disclaimer, the term of this patent is extended or adjusted under 35 U.S.C. 154(b) by 0 days.

(21) Appl. No.: 15/377,851

(22) Filed: Dec. 13, 2016

(65) Prior Publication Data

US 2017/0089667 A1 Mar. 30, 2017

Related U.S. Application Data

(63) Continuation of application No. 14/713,520, filed on May 15, 2015, now Pat. No. 9,557,141.

(51) Int. Cl.
*F41G 1/00* (2006.01)
*F41G 1/34* (2006.01)

(52) U.S. Cl.
CPC ..... *F41G 1/345* (2013.01)

(58) Field of Classification Search
CPC ..... F41G 1/345
USPC ..... 42/124–128
See application file for complete search history.

(56) References Cited

U.S. PATENT DOCUMENTS 3,439,970 A * 4/1969 Rickert ..... F41G 1/02 42/120
3,502,416 A * 3/1970 Rickert ..... F41G 1/30 33/1 C
4,375,725 A 3/1983 Orlob
5,283,689 A 2/1994 Carlough
D447,206 S * 8/2001 Ling, Jr. ..... D22/108
7,821,708 B2 * 10/2010 Robitaille ..... F41G 1/345 359/399
7,921,591 B1 4/2011 Adcock
8,151,510 B2 * 4/2012 Capson ..... F41G 1/01 42/111
8,166,698 B2 * 5/2012 Raviv ..... F41G 1/345 42/113
8,997,391 B2 * 4/2015 Rozic ..... F41G 1/02 42/111

(Continued)

OTHER PUBLICATIONS

Notice of allowance dated Nov. 10, 2016, in U.S. Appl. No. 14/713,520, filed May 15, 2015.

(Continued)

*Primary Examiner* — Samir Abdosh
(74) *Attorney, Agent, or Firm* — Workman Nydegger

(57) ABSTRACT

Kits, apparatus, assemblies, and methods for mounting sighting devices are disclosed. A sighting device includes a base for coupling the sighting device to an object at a first interface, a mounting element connected to the base at a second interface, and a sighting element connected to the mounting element. A channel disposed in the bottom of the base is aligned with a channel disposed in the surface of the object and a channel insert is secured within both channels to securely couple the sighting device to the object. The secure coupling can resist movement of the sighting device relative to the object in at least one direction. The sighting element has a non-opaque body displaying a reticle. An illuminating element backlights the reticle from a first vantage point. The device optionally includes an opaque mounting body and a magnifying optic aligned with the sighting element in an open sight configuration.

34 Claims, 24 Drawing Sheets

(56) References Cited

U.S. PATENT DOCUMENTS

| | | | | |
|---|---|---|---|---|
| 9,557,141 | B2 | 1/2017 | Capson | |
| 2002/0078618 | A1 | 6/2002 | Gaber | |
| 2008/0092424 | A1* | 4/2008 | Keng | F41G 1/18 42/137 |
| 2009/0019758 | A1* | 1/2009 | Baugher | F41G 1/14 42/111 |
| 2009/0109529 | A1* | 4/2009 | Robitaille | F41G 1/345 359/428 |
| 2010/0083554 | A1* | 4/2010 | Elpedes | F41G 1/14 42/123 |
| 2011/0035980 | A1* | 2/2011 | Raviv | F41G 1/345 42/1.02 |
| 2011/0107650 | A1* | 5/2011 | Howe | F41G 1/10 42/132 |
| 2011/0314721 | A1* | 12/2011 | Lamb | F41G 1/10 42/145 |
| 2012/0047788 | A1* | 3/2012 | Capson | F41G 1/01 42/130 |
| 2013/0219767 | A1* | 8/2013 | Peterson | F41G 11/003 42/113 |
| 2013/0255129 | A1* | 10/2013 | Curry | F41G 1/00 42/144 |
| 2014/0096430 | A1* | 4/2014 | Kruse | F41G 1/345 42/132 |
| 2014/0259855 | A1* | 9/2014 | Abo | F41G 1/345 42/132 |
| 2015/0059225 | A1* | 3/2015 | Huang | F41G 1/30 42/113 |

OTHER PUBLICATIONS

Issue Notification dated Jan. 11, 2017, in U.S. Appl. No. 14/713,520, filed May 15, 2015.

* cited by examiner

BACKLIT SIGHTING DEVICE

CROSS REFERENCE TO RELATED APPLICATIONS

The present application is a continuation of U.S. patent application Ser. No. 14/713,520, filed May 15, 2015, entitled "Backlit Sighting Device," the entirety of which is incorporated by reference herein.

BACKGROUND

1. Technical Field

The present disclosure relates generally to sighting devices. More particularly, the present disclosure relates to sighting devices making use of an optical element. More particularly still, sighting devices of the present disclosure may include a partial or incomplete optical element and be used to sight any number of different objects or in a diverse set of applications.

2. Relevant Technology

A variety of different types of gun sights have been widely used. Such sights have included, for instance, open sights, aperture sights, scopes, red dot sights, and laser sights. A common type of open sight is a post-and-notch type sight. Such an open sight may, for instance, include a post that projects upwardly a small distance near the distal end of a gun barrel. To make use of the open sight, the post may be aligned with a notch near the proximal end of the gun. The aligned post and notch can then be placed on or pointed at the target in the field of view.

Aperture sights are available in various varieties. One common aperture sight is a peep sight, and is particularly common on rifles. In its basic form, a peep sight generally includes two openings or holes. One opening is typically mounted near the proximal end of the rifle, and the other opening is mounted towards the distal end of the rifle. The shooter may then make use of the peep sight by aligning the two apertures so as to sight through them at the target. In some cases, an aperture sight may also include a post or blade near the distal end of the gun barrel, and the post or blade may be aligned in the aperture at the proximal end of the gun.

Unlike open sights or aperture sights, a scope makes use of magnification to magnify the target, whereas open sights and aperture sights typically do not magnify the target. Scopes are available in a wide variety of forms, and may include different features for magnification, focus, day/night use, and the like.

In a basic form, a scope makes use of an ocular lens and an objective lens. The objective lens is positioned near the distal end of the gun and controls the amount of light that can be transmitted to the ocular lens. The ocular lens is located nearer the proximal end of the gun, and is the eyepiece through which the user will look through the scope. The scope operates in essentially the same manner as a telescope, and as light passes through the objective ends it will focus on a point inside the scope. The ocular lens magnifies the light from a focal point. In viewing the image through the scope, the light is shown as an image. The scope also typically includes a crosshair reticle that can be aligned on the reflected, magnified image.

Red dot sights and laser sights are also available, and are most common in connection with governmental and military firearms. A red dot sight projects an image of the target, along with a red or other colored dot on top of the projected image. The red dot can then be aligned on a particular location of the projected image to aim the firearm. The red dot on the image is maintained within the housing of the sight, and is not projected outside the end of the sight. In contrast, a laser sight will project one or more laser beams towards a target. The red or other colored laser beam will illuminate the targeted location.

The above discussion relates generally to sights for firearms, but sights may also be used in other applications. For instance, sights may be used in archery or other firearms, or with transits, theodolites, or other types of equipment. In traditional archery bow sights, for instance, multiple aiming points may be mounted to the bow handle. A peephole or other aperture may be mounted on the bowstring. To sight the target, the archer may align the desired aiming point with the target and the peephole.

Regardless of the type of sight that has previously been employed, each sight offers various benefits and drawbacks. Open and aperture sights, for instance, are inexpensive and generally lightweight. Open and aperture sights can also resist, to some degree, undesirable movement or misalignment. While such sights are often suitable for targets at a short distance, existing open and aperture sights are widely considered to lack accuracy at large distances. In addition, precision and/or consistency are often a problem with open and aperture sights, especially for inexperienced shooters, as alignment of proximal and distal sighting elements is required in each instance. Furthermore, such sights often lack a quality illuminating features. For instance, while open sights may use a "glow-in-the-dark" paint dot on one or more of the post or notch tips, such illumination does not solve the drawbacks of such sights, and aperture sights do not typically include an illuminating feature.

Increased accuracy, precision, and/or consistency can, however, be accommodated with a laser sight, red dot sight, or scope. Such accuracy comes at a significant cost, however, as the sights can be very expensive. For instance, sights having an ocular lens and an objective lens can cost hundreds or even thousands of dollars. In addition to being expensive, sights having increased accuracy (e.g., as compared to open or aperture sights) may also be heavy, use an external power source, or be highly sensitive to lighting conditions. For instance, red dot and laser sights require are often battery-powered, which can be inconvenient and difficult to change, especially in a unexpected shooting situation.

Closed sights, such as red dot sights or scopes, also require a shooter to view the target through an artificial viewing frame of reference. Accordingly, a shooter cannot simultaneously view the surrounding/peripheral environment while looking through the closed lens sight. Such loss of peripheral vision during shooting with a closed sight can be dangerous and can even reduce accuracy, precision, and/or consistency of shot. Furthermore, closed sights can often be laborious to mount and/or may easily become misaligned (e.g., as the gun is shot and/or as the scope is impacted).

Accordingly, what is desired is a sighting device that is lightweight, relatively cost-effective, accurate at small or large distances, effectively illuminated, and/or easily mountable and/or securable to the gun so as to avoid undesirable movement or misalignment.

BRIEF SUMMARY

Exemplary embodiments of the present disclosure generally relate to sighting devices and assemblies, as well as kits and methods incorporating the same. In particular, some embodiments of the present disclosure relate to a backlit open sighting device and/or mechanisms and methods for mounting a sighting device to a support structure. Additional embodiments relate to kits for mounting a sighting device to a support structure.

An illustrative sighting device can include a base having a first connection component for coupling the sighting device to an object (e.g., a firearm) at a first interface. The first connection component can comprise a channel and/or a channel insert (e.g., disposed in or on the bottom surface of the base). In at least one embodiment, the first connection component can comprise a channel disposed in the bottom surface of the base and configured to be aligned with a channel and/or channel insert disposed in or on the surface of the object. For instance, the object can comprise a firearm (e.g., a handgun) having a (transverse) channel disposed in an upper portion thereof. A first portion of a channel insert (e.g., dovetail) can be secured within the (dovetail) channel of the object (e.g., by means of a friction fit and/or one or more set screws). The channel disposed in the bottom of the base can be aligned with a channel insert such that a second portion of the channel insert fits within the channel of the base. The base can also be secured to the channel insert (e.g., with one or more fasteners). Accordingly, the channel insert can be secured within both channels to securely couple the sighting device to the firearm.

Alternative embodiments can include a channel insert secured to the bottom of the base or the upper portion of the firearm and configured to be aligned with, inserted into, and/or secured within a channel of a corresponding piece. For instance, the channel insert can be integral with the base and securable within the channel of the firearm. Additional embodiments can include inserting a channel insert simultaneously into the aligned channels. Regardless of the specific configuration, the secure coupling between the base and the object can resist movement of the sighting device relative to the object in at least one direction (e.g., in a plurality of planes and/or in any direction).

The sighting device can also include a mounting element connected to the base at a second interface. For instance, the mounting element can be received and/or secured within a receiving area in the upper surface of the base. A sighting element can be connected to the mounting element. The sighting element can include a non-opaque body displaying at least one reticle. The mounting element can include an optionally opaque body to which the sighting element can be mounted to provide a contrast and/or shielding effect from one or more directions and/or orientations.

An optional illuminating element can provide backlighting for the reticle from a first vantage point. For instance, the illuminating element can be disposed on or in the mounting element (e.g., in the optional opaque body thereof). The sighting element can be mounted on or to a portion of the mounting element (e.g., the optional opaque body). A window in the mounting element (or optional opaque body) can transmit light from the illuminating element to the sighting element, backlighting the reticle when viewed from the first vantage point. The backlighting can induce visibility of the reticle in one or more dark environments. For instance, the backlighting can make the reticle visible from the first vantage point at night and/or in a darkened room.

In certain embodiments, the optional opaque body shields light from the illuminating element from a second vantage point. For instance, from a vantage point (180°) opposite the first vantage point, (direct) light from the illuminating can be shielded by the opaque body. The sighting device also optionally includes a (magnifying) optical component (e.g., lens) aligned with the sighting element (e.g., in an open sight configuration). For instance, the base can comprise a connection component for receiving a (segmented) optic such that the backlit reticle is visible and/or magnified through the optic from the first vantage point.

Additional features and advantages of example embodiments will be set forth in the description which follows, and in part will be obvious from the description, or may be learned by the practice of the invention. The features and advantages of the embodiments herein may be realized and obtained by means of the instruments and combinations particularly pointed out in the appended claims. These and other features of the present disclosure will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, or to further clarify the above and other advantages and features of the present disclosure, a more particular description of the disclosure briefly described above will be rendered by reference to specific implementations and/or embodiments thereof which are illustrated in the appended drawings. While the drawings are generally drawn to scale for some example embodiments, it should be understood that the scale may be varied and the illustrated embodiments are not necessarily drawn to scale for all embodiments encompassed herein.

Furthermore, it will be readily appreciated that the components of the illustrative embodiments, as generally described and illustrated in the figures herein, could be arranged and designed in a wide variety of different configurations, and that components within some figures are interchangeable with, or may supplement, features and components illustrated in other figures. Accordingly, understanding that the drawings depict only typical implementations and/or embodiments of the disclosure and are not therefore to be considered to be limiting of its scope, the embodiments will be described and explained with additional specificity and detail through the use of the accompanying drawings in which.

DETAILED DESCRIPTION

Figure 1A:
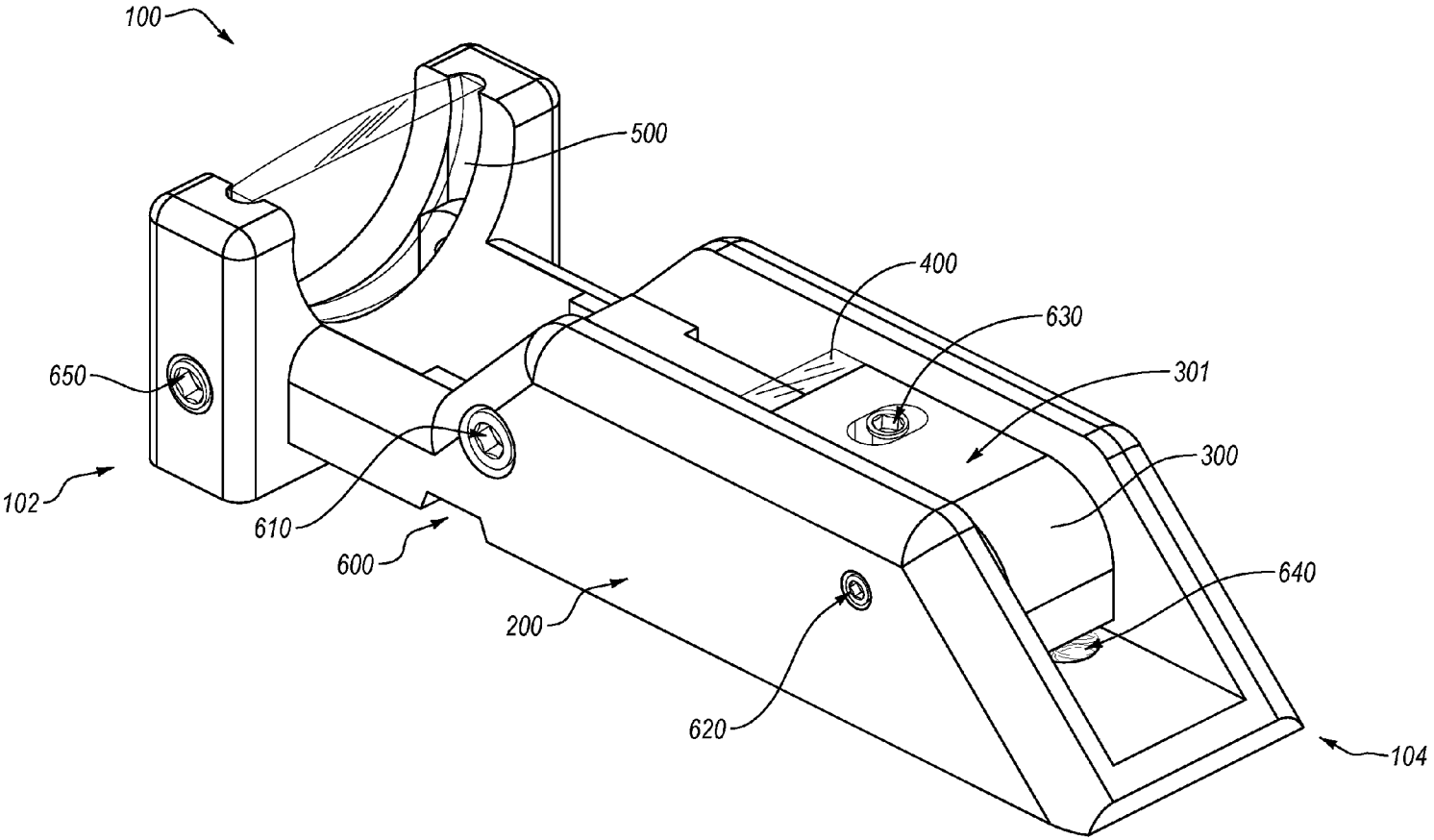
FIG. 1A illustrates a perspective view of a sighting device according to one embodiment of the present disclosure, and in which the sight includes a sighting element and an optical component for magnifying the sighting element.

Before describing the present disclosure in detail, it is to be understood that this disclosure is not limited to parameters of the particularly exemplified systems, methods, apparatus, assemblies, products, processes, and/or kits, which may, of course, vary. It is also to be understood that the terminology used herein is only for the purpose of describing particular embodiments of the present disclosure, and is not necessarily intended to limit the scope of the disclosure in any manner. Thus, while the present disclosure will be described in detail with reference to specific configurations, the descriptions are illustrative and are not to be construed as limiting the scope of the claimed invention. Various modifications can be made to the illustrated configurations without departing from the spirit and scope of the invention as defined by the claims. Thus, while various aspects and embodiments have been disclosed herein, other aspects and embodiments are contemplated.

Unless defined otherwise, all technical and scientific terms used herein have the same meaning as commonly understood by one of ordinary skill in the art to which the present disclosure pertains. While a number of methods and materials similar or equivalent to those described herein can be used in the practice of the present disclosure, only certain exemplary materials and methods are described herein.

Various aspects of the present disclosure, including devices, systems, methods, etc., may be illustrated with reference to one or more exemplary embodiments or implementations. As used herein, the terms "exemplary embodiment" and/or "exemplary implementation" means "serving as an example, instance, or illustration," and should not necessarily be construed as preferred or advantageous over other embodiments or implementations disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

It will be noted that, as used in this specification and the appended claims, the singular forms "a," "an" and "the" include plural referents unless the content clearly dictates otherwise. Thus, for example, reference to a "line" includes one, two, or more lines. Similarly, reference to a plurality of referents should be interpreted as comprising a single referent and/or a plurality of referents unless the content and/or context clearly dictate otherwise. Thus, reference to "lines" does not necessarily require a plurality of such lines. Instead, it will be appreciated that independent of conjugation; one or more lines are contemplated herein.

As used throughout this application the words can and may are used in a permissive sense (i.e., meaning having the potential to), rather than the mandatory sense (i.e., meaning must). Additionally, the terms "including," "having," "involving," "containing," "characterized by," variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

Various aspects of the present disclosure can be illustrated by describing components that are coupled, attached, connected, and/or joined together. As used herein, the terms "coupled", "attached", "connected," and/or "joined" are used to indicate either a direct connection between two components or, where appropriate, an indirect connection to one another through intervening or intermediate components. In contrast, when a component is referred to as being "directly coupled", "directly attached", "directly connected," and/or "directly joined" to another component, no intervening elements are present or contemplated. Thus, as used herein, the terms "connection," "connected," and the like do not necessarily imply direct contact between the two or more elements. In addition, components that are coupled, attached, connected, and/or joined together are not necessarily (reversibly or permanently) secured to one another. For instance, coupling, attaching, connecting, and/or joining can comprise placing, positioning, and/or disposing the components together or otherwise adjacent in some implementations.

As used herein, directional and/or arbitrary terms, such as "top," "bottom," "front," "back," "rear," "left," "right," "up," "down," "upper," "lower," "inner," "outer," "internal," "external," "interior," "exterior," "proximal," "distal" and the like can be used solely to indicate relative directions and/or orientations and may not otherwise be intended to limit the scope of the disclosure, including the specification, invention, and/or claims.

Where possible, like numbering of elements have been used in various figures. Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular embodiment(s) in which they are illustrated. In other words, reference to a specific feature in relation to one embodiment should not be construed as being limited to applications only within said embodiment.

It will also be appreciated that where a range of values (e.g., less than, greater than, at least, and/or up to a certain value, and/or between two recited values) is disclosed or recited, any specific value or range of values falling within the disclosed range of values is likewise disclosed and contemplated herein. Thus, disclosure of an illustrative measurement or distance less than or equal to about 10 units or between 0 and 10 units includes, illustratively, a specific disclosure of: (i) a measurement of 9 units, 5 units, 1 units, or any other value between 0 and 10 units, including 0 units and/or 10 units; and/or (ii) a measurement between 9 units and 1 units, between 8 units and 2 units, between 6 units and 4 units, and/or any other range of values between 0 and 10 units.

It is also noted that systems, methods, apparatus, devices, products, processes, and/or kits, etc., according to certain embodiments of the present disclosure may include, incorporate, or otherwise comprise properties, features, components, members, and/or elements described in other embodiments disclosed and/or described herein. Thus, reference to a specific feature in relation to one embodiment should not be construed as being limited to applications only within said embodiment.

The headings used herein are for organizational purposes only and are not meant to be used to limit the scope of the description or the claims. To facilitate understanding, like reference numerals have been used, where possible, to designate like elements common to the figures.

Exemplary embodiments of the present disclosure generally relate to sighting devices and assemblies, as well as kits and methods incorporating the same. In particular, some embodiments of the present disclosure relate to a backlit open sighting device and/or mechanisms and methods for mounting a sighting device to a support structure (e.g., an object such as a firearm). Additional embodiments relate to kits for mounting a sighting device to a support structure.

Some embodiments described herein generally extend to devices, assemblies, kits, systems, and methods for using a gun sight to target an object. Some devices of the present disclosure are configured to make use of a partial or incomplete optical component, so as to focus on a reticle while maintaining at least a portion of a targeted object within a field of view. Some embodiments include connection components for securely mounting the device to a gun. Some embodiments include an illuminating element for backlighting a sighting or targeting reticle of the device.

Reference will now be made to the drawings to describe various aspects of example embodiments of the disclosure. In the description, example sighting devices may be described with reference to guns, rifles, firearms, or other weapons. It should be appreciated that such objects are described by way of illustration only, and are not limiting of the present invention. Indeed, embodiments of the present disclosure may be used in connection with any number of different devices, including surveying equipment, range finding, or in connection with other equipment or firearms.

It is further to be understood that the drawings included herewith, and which are referenced herein, are diagrammatic and schematic representations of example embodiments, and are not limiting of the present disclosure. Moreover, while various drawings are provided at a scale that is considered functional for some embodiments, the drawings are not necessarily drawn to scale for all contemplated embodiments. No inference should therefore be drawn from the drawings as to the necessity of any scale.

In the exemplary embodiments illustrated in the figures, where possible, like structures will be provided with similar reference designations. Specific language will be used herein to describe the exemplary embodiments, nevertheless it will be understood that no limitation of the scope of the disclosure is thereby intended. It is to be understood that the drawings are diagrammatic and schematic representations of various embodiments of this disclosure, and are not to be construed as limiting the scope of the disclosure, unless such shape, form, scale, function, or other feature is expressly described herein as essential.

Alterations and further modifications of the inventive features illustrated herein, and additional applications of the principles illustrated herein, which would occur to one skilled in the relevant art and having possession of this disclosure, are to be considered within the scope of this disclosure. Unless a feature is described as requiring another feature in combination therewith, any feature herein may be combined with another feature of a same or different embodiment disclosed herein. Furthermore, various well-known aspects of optics, sighting, manufacturing processes, and the like are not described herein in particular detail in order to avoid obscuring aspects of the example embodiments.

Figure 1B:
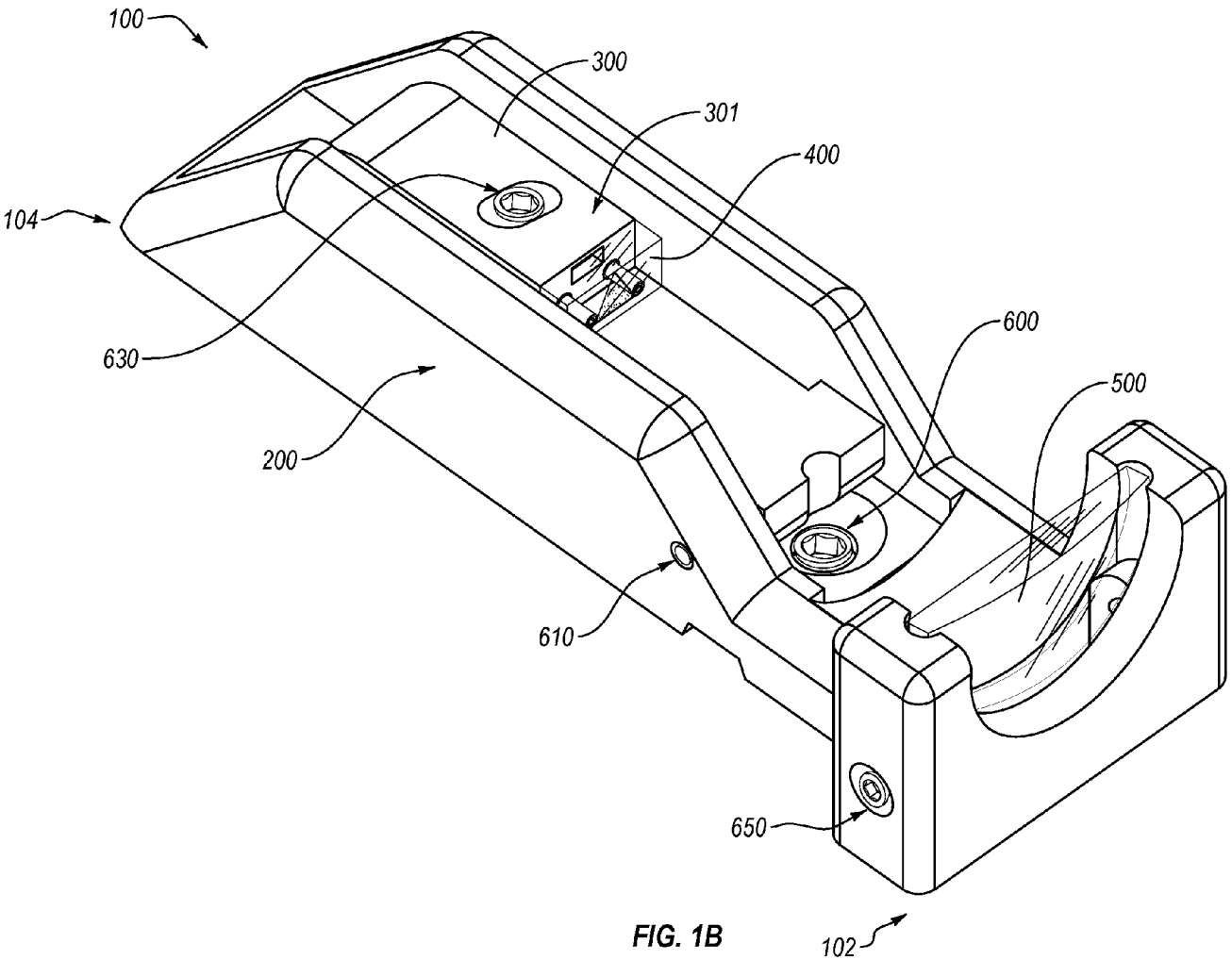
FIG. 1B illustrates a top plan view of the sighting device of FIG. 1A.
Figure 1C:
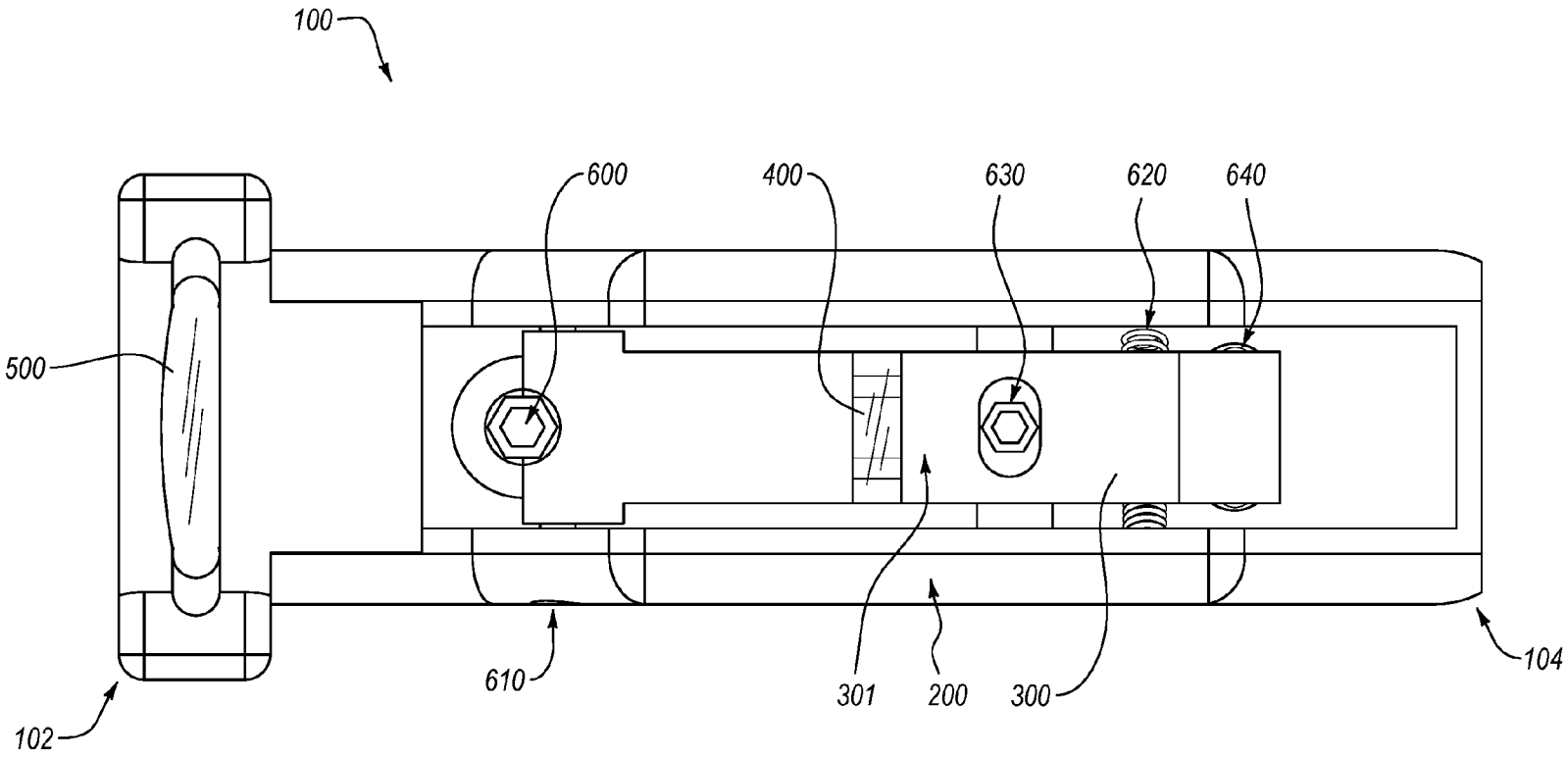
FIG. 1C illustrates a top plan view of the base of FIG. 1A.

Turning now to the drawings, FIGS. 1A-1B depict an illustrative embodiment of a sighting device assembly 100 incorporating features of the present disclosure. The sighting device assembly 100 may, for instance, be used and/or useful to sight an object. In particular, sighting device assembly 100 may be used and/or useful in connection with a handgun, rifle, or other type of firearm or other device to sight an object and/or to facilitate accurate projection of a bullet, slug, arrow, or other projectile at the target. In alternative embodiments, however, sighting device assembly 100 may be used and/or useful in connection with any number of different devices, including surveying equipment, range finding, or in connection with other equipment. Accordingly, sighting device assembly 100 may be mounted, attached, connected, and/or secured to a support structure and/or surface thereof at a first interface. For instance, a bottom portion or surface of sighting device assembly 100 may be joined with a top portion or surface of a support structure at the first interface in certain embodiments.

As illustrated in FIGS. 1A-1B, at least one embodiment of the sighting device assembly 100 may generally comprise a base 200, a sighting assembly 301, and/or an optical component 500. In certain embodiments, sighting assembly 301 can comprise a mounting element 300, sighting element 400, and/or an illuminating element 700 (see FIGS. 5A-5B). Sighting device assembly 100 may also comprise at least one securing mechanism 600, at least one (mounting element or sighting assembly) attachment mechanism 610, at least one lateral adjustment mechanism 620, at least one vertical adjustment mechanism 630, one or more biasing members 640, and/or one or more optical component attachment mechanisms 650.

To facilitate discussion herein, sighting device assembly 100 (and/or one or more components thereof) may be referred to as having a distal end 104 and/or a proximal end 102. In such context, and with regard to the figures, optical component 500 may be positioned at, near, or toward the proximal end 102 of sighting device assembly 100, whereas sighting assembly 301 (or mounting element 300 and/or sighting element 400 thereof) may be positioned at, near, or toward the distal end 104 of sighting device assembly 100.

It should be appreciated in view of the disclosure herein that the reference to "ends" of sighting device assembly 100 and/or one or more components thereof (such as proximal or distal) is purely arbitrary so as to facilitate a description of the exemplary embodiments herein, and that in other embodiments, the proximal end could be referred to as the distal end, and vice versa. Furthermore, it should be appreciated in view of the disclosure herein that the reference to "ends" of sighting device assembly 100 and/or one or more components thereof (such as proximal or distal) does not necessarily imply that such ends are positioned terminally (e.g., so as to indicate a terminal end of sighting device assembly 100 and/or one or more components thereof). Instead, such terms are included to assist in orienting one of ordinary skill in the art and providing a description of relative position.

Additional details of the various components in accordance with some embodiments of the sighting device assembly 100 will now be described in further detail with continued reference to FIGS. 1A-1B, when necessary.

As illustrated in FIGS. 2A-2F, base 200 can comprise a floor 202 extending between a proximal end 206 and an opposing distal end 208 of base 200. Floor 202 can have an upper surface 204 and an opposing lower surface 206. A distance between upper surface 204 and opposing lower surface 206 may define a thickness of base 200 and/or floor 202 thereof. Such thickness may be generally constant, although in other embodiments the thickness may vary.

Floor 202 can also have one or more openings, apertures, recesses, and/or protrusions disposed therein and/or extending therefrom. For instance, floor 202 can have at least one securing aperture 210 disposed therein and/or extending therethrough. As discussed in further detail below, securing aperture 210 can comprise a feature of securing mechanism 600 and/or can at least partially secure base 200 to a support structure or surface thereof. Base 200 can also comprise one or more beveled surfaces 211. For instance, upper surface 204 of floor 202 can taper and/or bevel into securing aperture 210. As discussed in further detail below, securing aperture 210 and/or beveled surface 211 can be configured to receive one or more connection component fasteners (e.g., for securing base 200 to a connection component).

Floor 202 can also have a vertical adjustment mount 214 extending upwardly therefrom. As depicted in the illustrated embodiment, vertical adjustment mount 214 can be disposed between securing aperture 210 and vertical adjustment seat(s) 212. In an alternative embodiment, however, vertical adjustment seat(s) 212 may be disposed between (proximal) securing aperture 210 and (distal) vertical adjustment mount 214. Furthermore, securing aperture 210 may be positioned at or near distal end 208, while vertical adjustment seat(s) 212 and/or vertical adjustment mount 214 may be positioned at or near proximal end 206. Indeed, it will be appreciated that the particular position and/or location of various features depicted in the illustrated embodiment may be positioned, located, and/or oriented differently in various alternative embodiments without necessarily departing from the scope of this disclosure.

In at least one embodiment, vertical adjustment mount 214 and/or floor 202 can have one or more vertical adjustment openings 216 extending therethrough and/or disposed therein. In at least one embodiment, vertical adjustment opening 216 can extend entirely through vertical adjustment mount 214 and floor 202. In an alternative embodiment, vertical adjustment opening 216 can extend partially through vertical adjustment mount 214 and/or floor 202. As discussed in further detail below, vertical adjustment mount 214 can correspond with a (lower) mounting surface of mounting element 300.

Floor 202 can also have one or more vertical adjustment seats 212. For instance, in at least one embodiment, floor 202 can comprise a first vertical adjustment seat 212*a* and an optional second vertical adjustment seat 212*b* disposed therein (e.g., adjacent to distal end 208 of base 200). As discussed in further detail below, vertical adjustment seat(s) 212 can be configured to receive one or more biasing members, such as biasing member 640 illustrated in FIG. 1A (e.g., for biasing mounting element 300 away from floor 202 and/or upper surface 204 thereof).

In some embodiments, base 200 can also include a first sidewall 220 and an opposing second sidewall 222 at least partially bounding a receiving area 203. For instance, floor 202 and/or upper surface 204 thereof, first sidewall 220, and second sidewall 222 can at least partially bound receiving area 203. Sidewalls 220, 222 can each have an outer surface 220*a*, 222*a* and an opposing inner surface 220*b*, 222*b*.

In addition, sidewalls 220, 222 can have one or more openings and/or apertures disposed therein and/or extending therethrough. For instance, first sidewall 220 can have an attachment aperture 224 disposed therein and/or extending therethrough. Attachment aperture 224 can comprise a beveled surface in some embodiments. Second sidewall 222 can have an attachment opening 226 (e.g., aligned with attachment aperture 224 of first side wall 220).

In at least one embodiment, at least attachment opening 226 can have one or more threads disposed therein. Accordingly, at least attachment opening 226 can comprise a threaded opening. As discussed in further detail below, attachment aperture 224 and/or attachment opening 226 can comprise features of attachment mechanism 610 and/or be configured to attach mounting element 300 to base 200 (e.g., within receiving area 203).

First sidewall 220 can also have at least one lateral adjustment opening 228 disposed therein and/or extending therethrough. Lateral adjustment opening 228 can also comprise a threaded opening and/or have one or more threads disposed therein. In at least one embodiment, second sidewall 222 does not have an aperture and/or opening disposed therein and aligned with lateral adjustment opening 228 of first sidewall 220. As discussed in further detail below, lateral adjustment opening 228 can comprise a feature of lateral adjustment mechanism 620 and/or be configured to adjust to the position of mounting element 300 (e.g., within receiving area 203 and/or relative to base 200 or a portion thereof).

Base 200 can also include an optical support or optic receiving element 230 (e.g., disposed at or near proximal end 206 thereof). In certain embodiments, optic receiving element 230 can comprise a support member 231 having a recessed portion 232 disposed therein (e.g., configured to receive an optical component such as optical component 500 illustrated in FIGS. 1A-1B). For instance, support member 231 of optic receiving element 230 can comprise a lower portion 236 and (opposing) side portion(s) 234. As depicted in the illustrated embodiment, recessed portion 232 is disposed in and/or extends between lower portion 236 and opposing side portions 234*a*, 234*b*.

Optic receiving element 230 and/or side portion(s) 234 thereof can also comprise one or more attachment openings 235. For instance, as depicted in the illustrated embodiment, opposing side portions 234*a*, 234*b* each have an attachment opening 235*a*, 235*b* extending therethrough (from an outer surface thereof to recessed portion 232). As discussed in further detail below, optic receiving element 230, support member 231, lower portion 236, side portion(s) 234, recessed portion 232, and/or attachment opening(s) 235 can comprise features of optical component attachment mechanisms 650 and/or be configured to secure an optical component (such as optical component 500 illustrated in FIGS. 1A-1B) to sighting device assembly 100 and/or base 200 thereof.

In some embodiments, base 200 can include a linker 240 (e.g., disposed between receiving area 203 and optic receiving element 230). In some embodiments, sidewall 220, 222 may not extend into linker 240. Base 200 (and/or a body portion thereof) may, in some instances, be configured to act as a retention structure. For instance, base 200 may be configured to retain mounting element 300, sighting element 400, and/or optical component 500 (e.g., at particular locations relative to each other or relative to the body of base 200). Base 200 may have any suitable shape, structure, dimension, or other feature, or any combination of the foregoing. In the embodiment illustrated in FIGS. 2A-2F, for instance, base 200 has a generally elongated form.

As indicated above, the distance between upper surface 204 and opposing lower surface 206 of floor 202 may define a thickness of base 200 and/or floor 202 thereof. Similarly, the width of base 200 may also be uniform or may change. For instance, the portion of base 200 extending from linker 240, through receiving area 203, and/or to distal end 208 may have a generally uniform width that may be defined generally by the distance between outer surfaces 220*a*, 222*a* of side walls 220, 222.

Optionally, the optical support 230 may have a differing width. For instance, as depicted in the illustrated embodiment (see FIGS. 2D and 2E), optical support 230 has a width that exceeds the distance between outer surfaces 220*a*, 222*a* of side walls 220, 222. In other embodiments, however, the optical support 230 may have a width that is less than or equal to the width of the distal portion of base 200 and/or floor 202 thereof. In some embodiments, the increased width of the optical support 230 (relative to the distal portion of base 200) may correspond to and/or accommodate a particular size of optical component (such as optical component 500 illustrated in FIGS. 1A-1B).

As illustrated more fully in FIGS. 2B and 2C, for instance, optical support 230 can also extend below the lower surface 206 of base 200 and/or floor 202 thereof. As discussed in further detail below, this lower extended portion of optic support 230 may be positioned beyond a rear portion of the surface of the support structure to which base 200 is configured to be secured. For instance, optical support 230 may be disposed rearward of the upper slide or other portion of a handgun to which base 200 is configured to be secured.

Figure 2A:
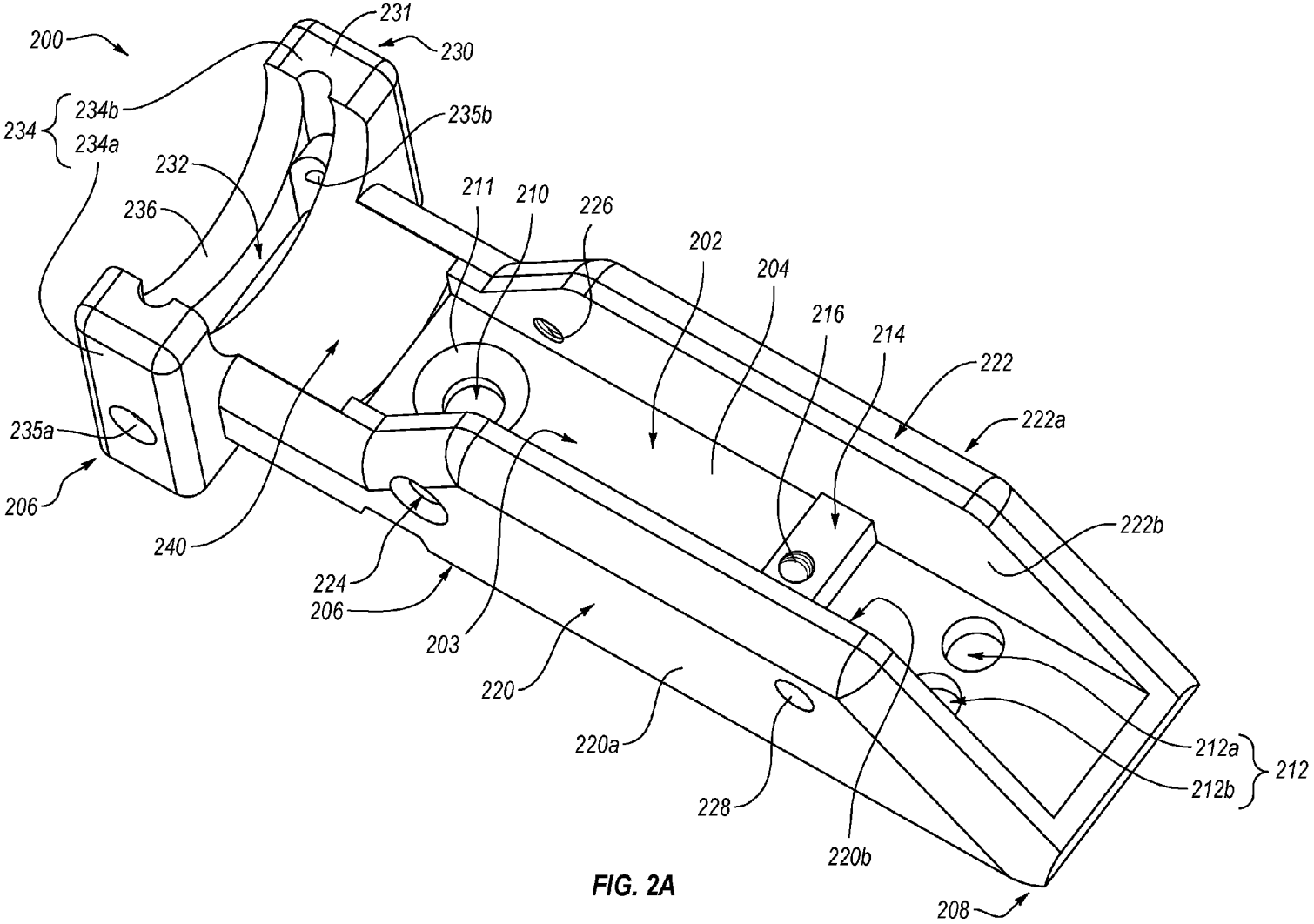
FIG. 2A illustrates a perspective view of an exemplary base useful in forming the sighting device of FIG. 1A according to one embodiment of the present disclosure.
Figure 2B:
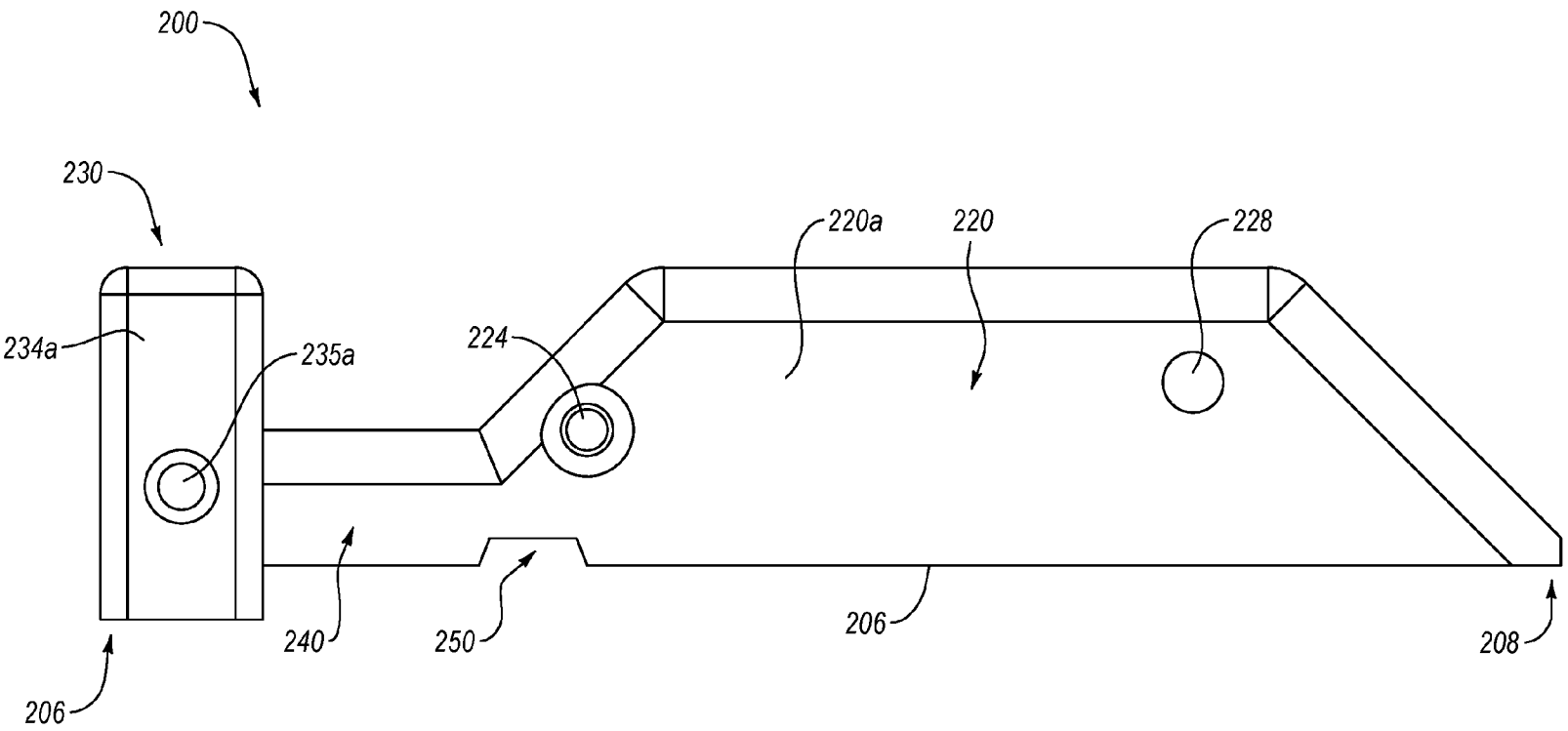
FIG. 2B illustrates a right side view of the base of FIG. 2A.
Figure 2C:
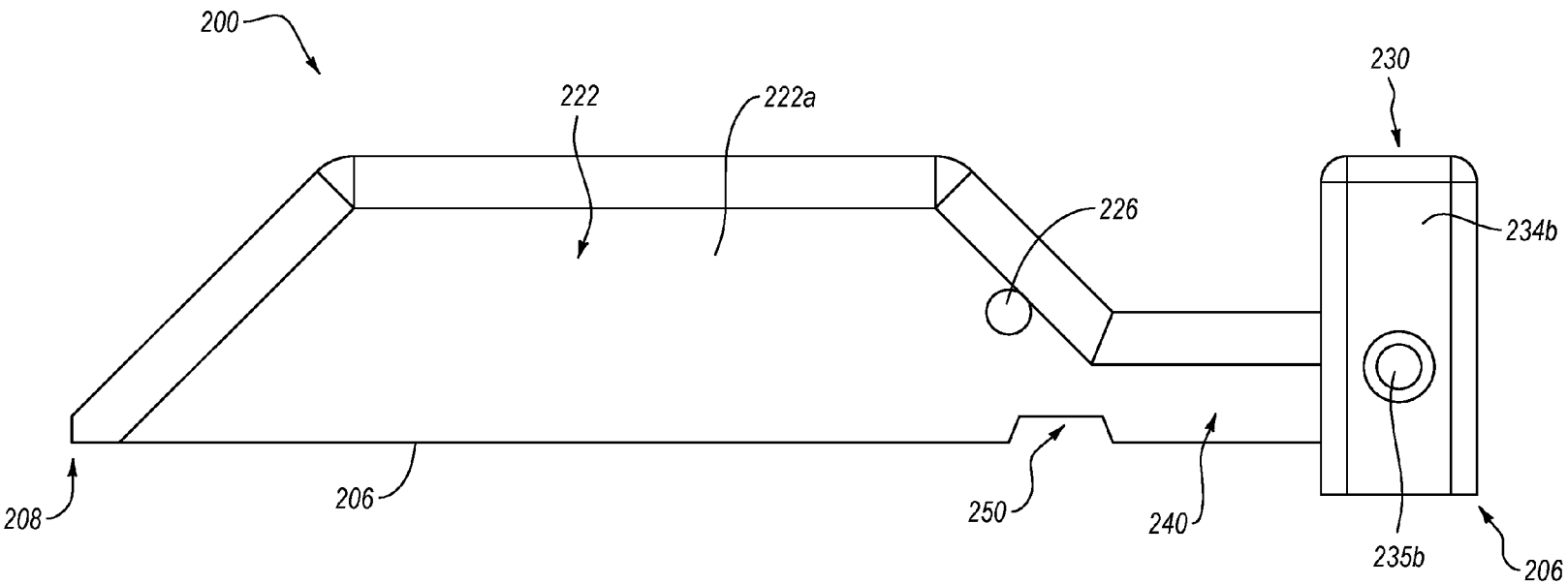
FIG. 2C illustrates a left side view of the base of FIG. 2A.
Figure 2D:
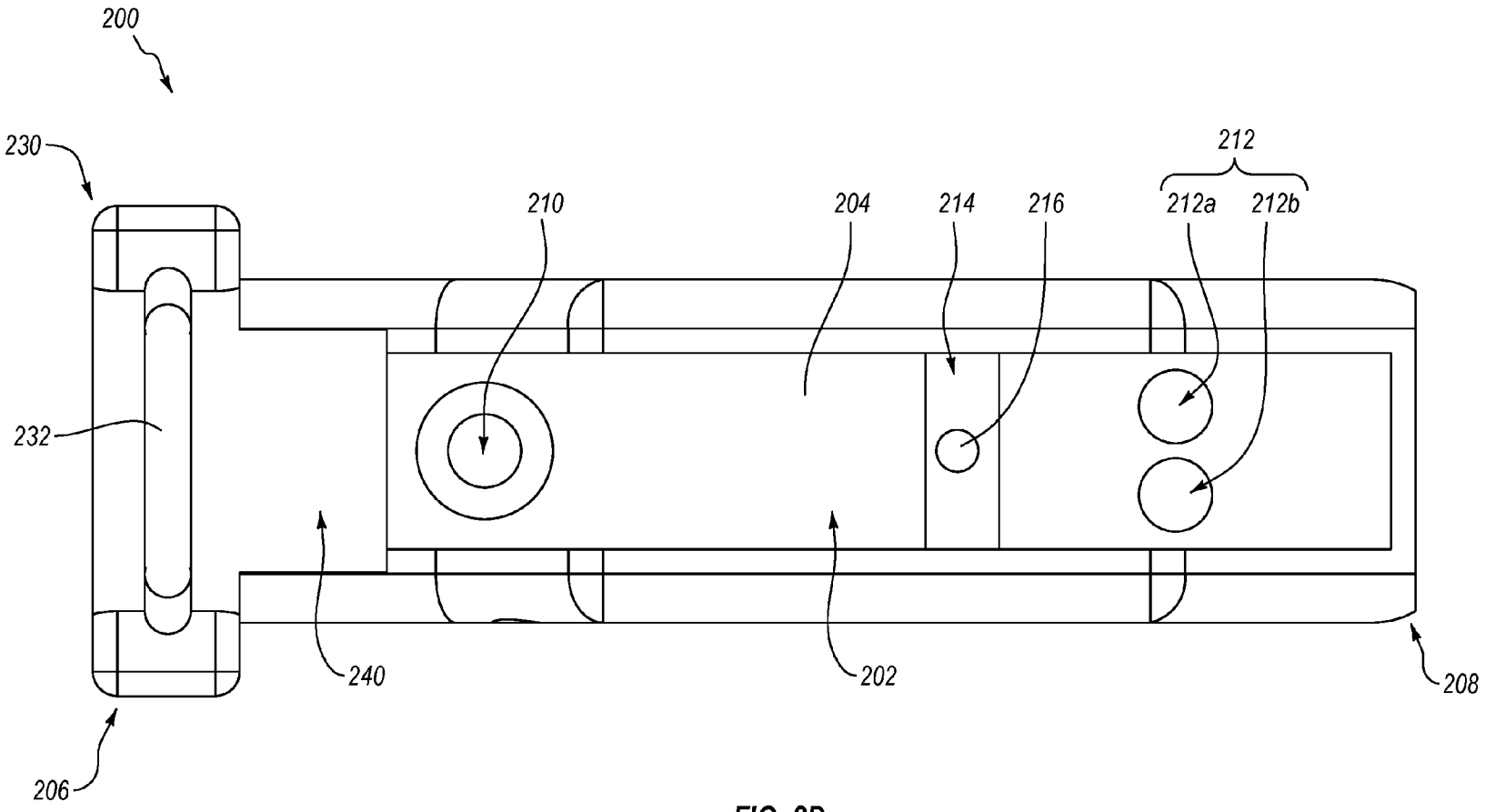
FIG. 2D illustrates a top plan view of the base of FIG. 2A.
Figure 2E:
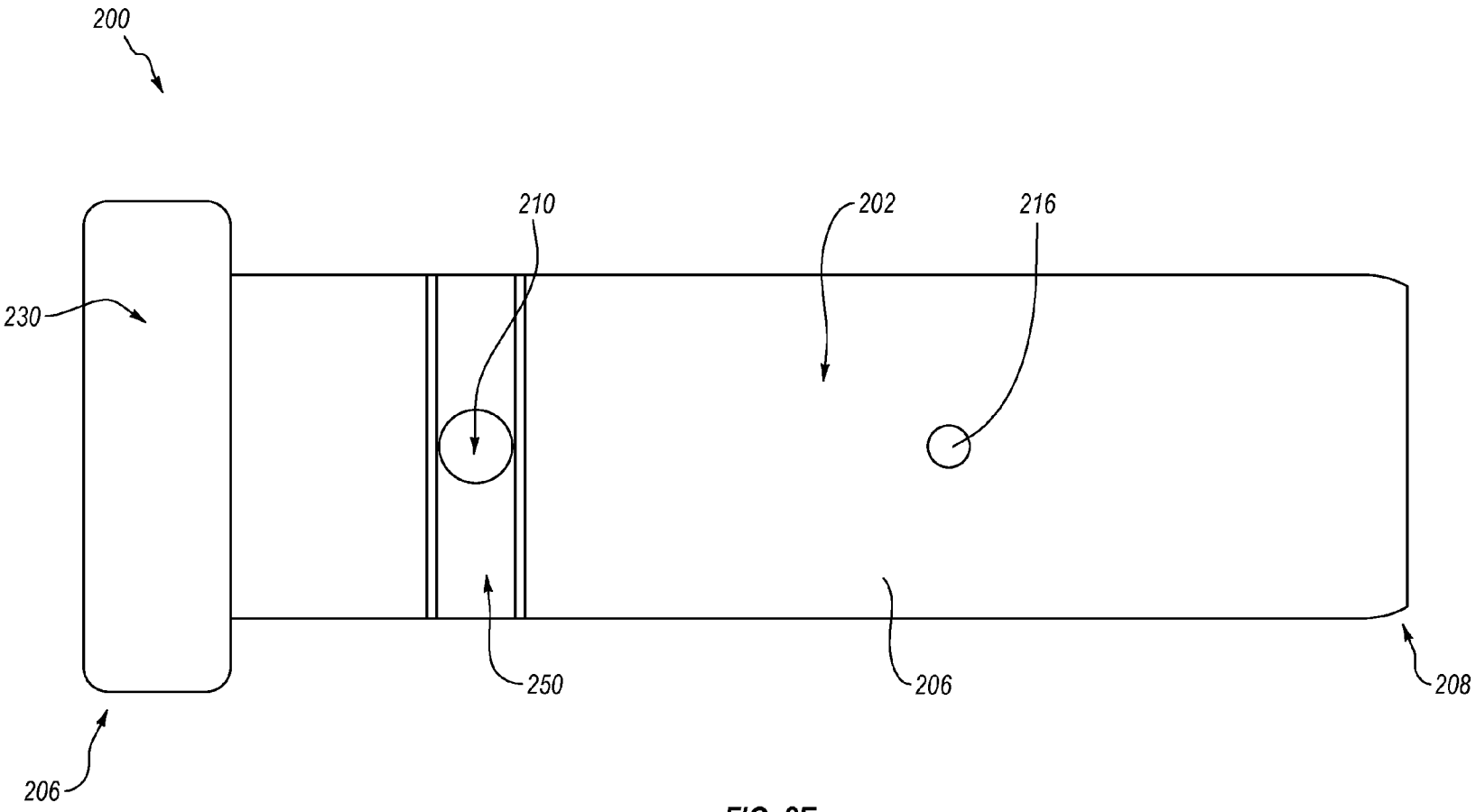
FIG. 2E illustrates a bottom plan view of the base of FIG. 2A.

FIGS. 2B and 2C further illustrates a connection component configured to at least partially secured base 200 to the surface of the support structure. In particular, base 200 can comprise a securing channel (or other connection component) 250 disposed on or in a lower portion of base 200 (e.g., recessed into lower surface 206 of base 200 and/or floor 202 thereof). As illustrated in FIG. 2E, securing aperture 210 can be aligned with and/or extend into securing channel 250. FIG. 2E also illustrates that the vertical adjustment opening 216 can extend (entirely) through vertical adjustment mount 214 and floor 202 and/or bottom surface 206 thereof.

Figure 2F:
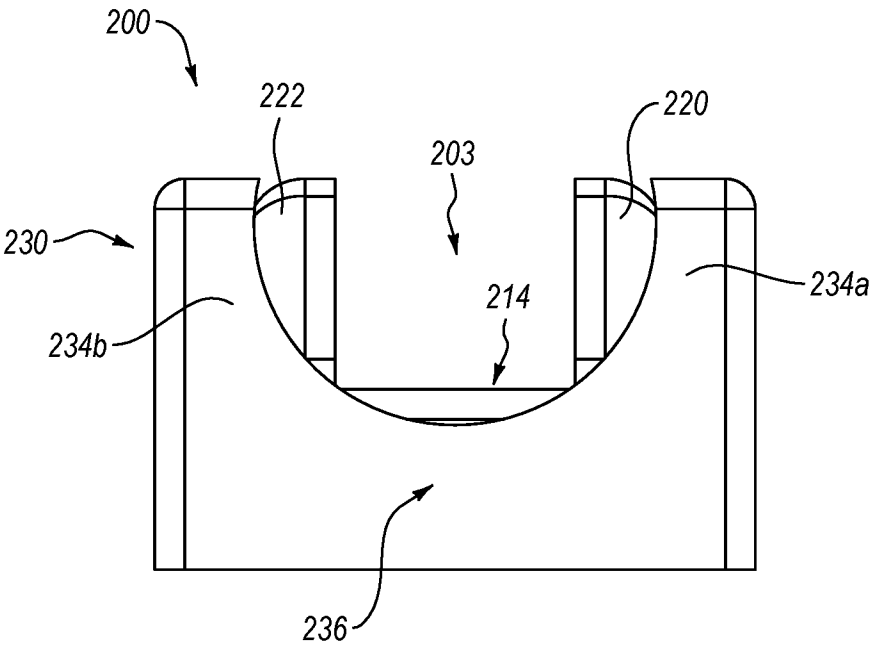
FIG. 2F illustrates a front elevation view of the base of FIG. 2A.

FIG. 2F depicts base 200 as viewed from a first vantage point (i.e., with proximal end 206 disposed proximally and distal end 208 disposed distally). As illustrated in FIG. 2F, receiving area 203 can be viewed through optic receiving element 230 (e.g., between the side portions 234*a* and 234*b* and above lower portion 236. In at least one embodiment, from the first vantage point, at least a portion of side walls 220 and 222 and/or at least a portion of vertical adjustment mount 214 can also be visible.

As illustrated in FIGS. 1A-1B, and with continued reference to FIGS. 2A-2F), in at least some embodiments, optical component 500 can be positioned and/or disposed within optic receiving element 230. In one or more illustrative embodiments, optical component 500 can include a lens or a component thereof. For instance, FIG. 1B depicts a top plan view of sighting device assembly 100. As illustrated in FIG. 1B, optical component 500 can be a lens having at least one convex surface 510. In particular, in the illustrated embodiment, optical component 500 is generally illustrated as a plano-convex lens. In other embodiments, however, other types of optics may be used. For instance, the optical component 500 may alternatively include a double-convex lens, a concavo-convex lens, or any other suitable lens or optical structure.

Optical component 500 may in some embodiments include a full lens, and in other embodiments may include a lens segment or a set of lens segments. According to the embodiment depicted in FIGS. 1A-1B, for instance, optical component 500 includes a partial or incomplete lens. More particularly, optical component 500 may include a lens segment that is approximately half of a full, circular lens. For instance, a full lens may be cut along a center thereof and then placed in optical support 230 (or recessed portion 232 thereof). A half-lens is merely one example of an optical component. In alternative embodiments, an optical component according to an embodiment of the present disclosure may include a quarter-lens, a full-lens, a three-quarter lens, or any other portion of a lens or optical component. Indeed, it is also not necessary that the optical component be formed from, or separated as a part of, a circular lens. For instance, the optical component may have a triangular, square, diamond-like, trapezoidal, cross-shaped, or other shape as desired.

Whatever the form of optical component 500, optical support 230 may be used to facilitate securement of optical component 500 to base 200 (or another component of sighting device assembly 100). For instance, recessed portion 232 can, in some embodiments, be sized and shaped so as to correspond generally to the size and shape of optical component 500. For instance, recessed portion 232 may have a generally rectangular cross-sectional shape, and follow along a semi-circular path in optical support 230. Optical component 500 may then be placed within the groove or recessed portion 232 and secured therein. For instance, groove 232 may have one or more fitting elements (e.g., gaskets) disposed therein and/or may provide a pressure retention fit or mechanism for securing optical component 500 therein.

Alternatively and/or in addition, one or more fasteners may secure optical component 500 within groove 232 and/or to optical support 230. For instance, optical component attachment mechanism 650 may include one or more fasteners configured to retain optical component 500 within groove 232 of optical support 230.

In the illustrated embodiment, the groove 232 is sized such that an upper surface of the optical component 500 is generally flush with an upper surface of the optical support 232, although this is merely exemplary. In other embodiments, an upper surface of the optical support 230 may be vertically higher or lower relative to the optical component 500. When positioned in the groove 232, the optical component 500 may be permanently or selectively secured therein using any suitable mechanism. For instance, in one embodiment, the optical component 500 has a friction or interference fit with the groove 232. In another embodiment, the optical component 500 is secured within the groove 232 using an adhesive. In still other embodiments, mechanical components (e.g., dovetail grooves) or other structures are used to securely maintain the optical component 500 in the groove 232 or otherwise within the optical support 230.

As further illustrated in FIGS. 1A-1B, and with some continued reference to FIGS. 2A-2F, sighting assembly 301 (or mounting element 300 thereof) can be attached to base 200 at a second interface. For instance, sighting assembly 301 (or mounting element 300 thereof) can be received within receiving area 203 and/or secured to a portion of base 200 (e.g., floor 202, sidewall(s) 220, 222, vertical adjustment mount 214, etc.). Methods for attaching and/or securing sighting assembly 301 (or mounting element 300 thereof) to base 200 will be described in further detail below. However, description of certain structural features of various embodiments of mounting element 300 will immediately follow.

As illustrated in FIGS. 3A-3H, mounting element 300 can comprise a body 302 extending from a proximal end 308 to a distal end 310 of mounting element 300. For instance, body 302 can comprise a base mounting member 304 disposed at or near proximal end 308 and a sight mounting member 306 disposed at or near distal end 310 of mounting element 300.

Figure 3A:
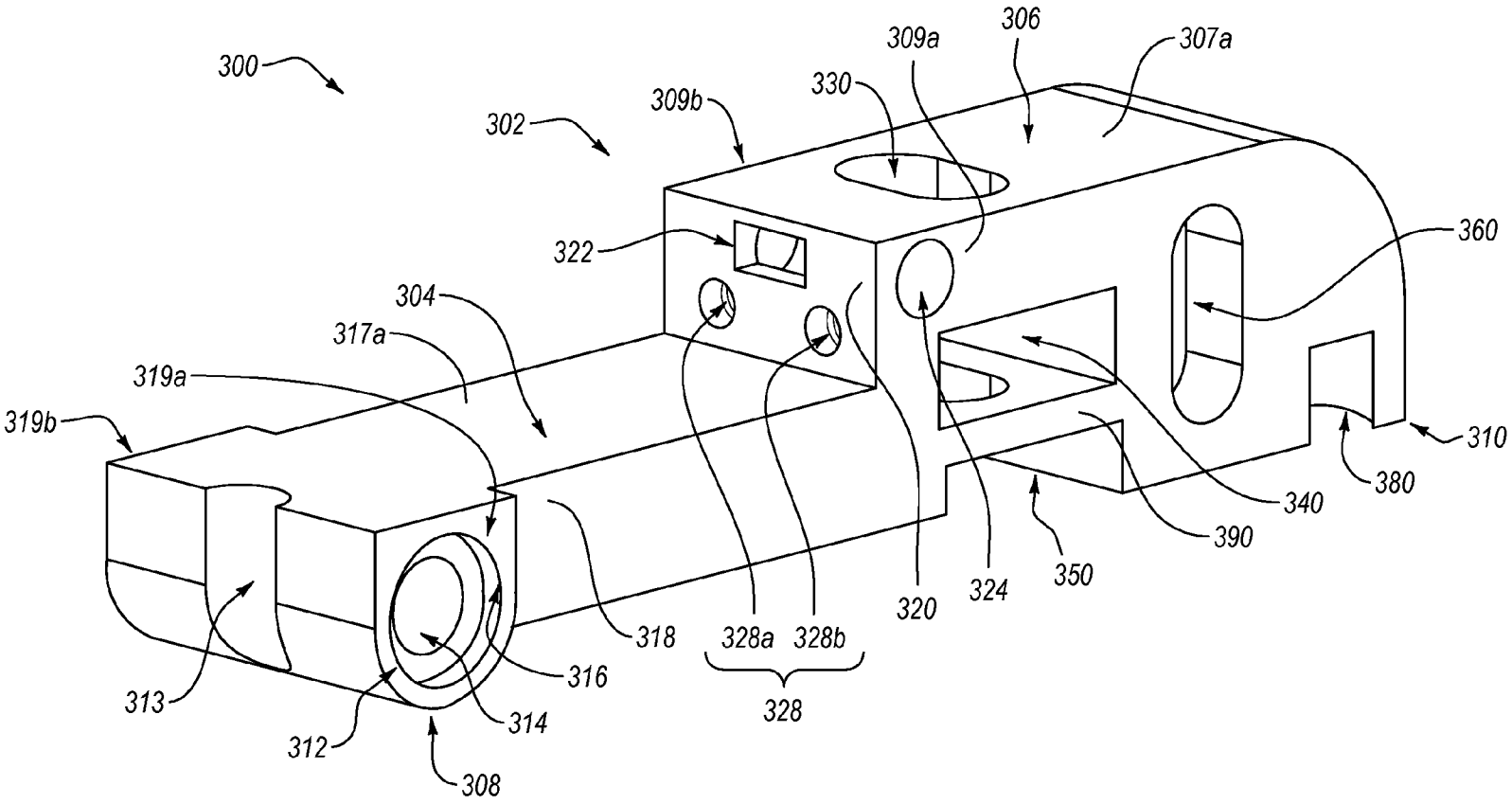
FIG. 3A illustrates a front perspective view of an exemplary mounting element useful in forming the sighting device of FIG. 1A according to one embodiment of the present disclosure.

Base mounting member 304 can comprise an arm 318 having an attachment member 312 (e.g., disposed at or near proximal end 308 of mounting element 300, base mounting member 304, and/or arm 318). Attachment member 312 can comprise an attachment channel 314 extending into and/or at least partially through arm 318. For instance, as illustrated in FIGS. 3C and 3D, in at least one embodiment, attachment channel 314 can extend entirely through arm 318 from a first side 319*a* to an opposing second side 319*b* thereof. Attachment member 312 can also include a channel seat or cavity 316. As described in further detail below, channel seat or cavity 316 can be configured to receive a fitting member (e.g., gasket, O-ring, cushioning element, etc.).

In certain embodiments, a distal end of base mounting member 304 can be connected to a proximal end of sight mounting member 306. In alternative embodiments, however, alternative positions, locations, and/or orientations may also be suitable. In the illustrated embodiment, sight mounting member 306 comprises a block connected to and/or extending upwardly from an upper surface 317*a* of arm 318 and/or base mounting member 304. Accordingly, sight mounting member 306 can comprise at least one attachment face 320 (e.g., disposed at a proximal end of sight mounting member 306 such that attachment face 320 is visible from the first vantage point described above). Attachment face 320 can be connected to and/or extend upwardly from upper surface 317*a* of arm 318 and/or base mounting member 304.

Attachment face 320 can have at least one illuminating window 322 disposed therein. In certain embodiments sight mounting member 306 can also have an illuminating channel 324 extending at least partially into the body portion of sight mounting member 306. As illustrated in FIGS. 3C and 3D, in at least one embodiment, illuminating channel 324 may not extend entirely through the body portion of sight mounting member 306 (e.g., from a first side 309*a* to an opposing second side 309*b*). In at least one embodiment, illuminating window 322 can extend from attachment face 322 to illuminating channel 324. As described in further detail below, illuminating channel 324 can be configured to receive at least one illuminating element. Accordingly, illuminating window 322 can be configured to transmit light from the illuminating element to attachment face 320.

In at least one embodiment, sight mounting member 306 can be substantially opaque or have a substantially opaque configuration. Accordingly, as illustrated in FIGS. 3A-3D and 3G-3H, one or more openings and/or apertures in attachment face 320 may not be visible through sight mounting member 306 (e.g., from the second vantage point and/or one or more additional vantage points).

Sight mounting member 306 can also have one or more (additional) openings, apertures, channels, and/or recesses disposed therein and/or extending therethrough. For instance, sight mounting member 306 can have at least one of vertical adjustment channel 330, at least one vertical adjustment socket 340, at least one mounting recess 350, at least one lateral adjustment channel 360, at least one lateral adjustment socket 370 (see FIGS. 3B and 3F), and/or at least one vertical adjustment recess (or seat) 380. Sight mounting member 306 can also have one or more support members 390.

As discussed in further detail below, vertical adjustment channel 330 can extend from upper surface 307*a*, through the body portion of sight mounting member 306, through vertical adjustment socket 340, through support member 390, to mounting recess 350, and/or to lower surface 307*b* (see e.g., FIG. 3F). As depicted in the illustrated embodiment, for instance, vertical adjustment channel 330 extends vertically, entirely through the body portion of sight mounting member 306. In an alternative embodiment, however, vertical adjustment channel 330 may extend only partially through the body portion of sight mounting member 306.

As depicted, vertical adjustment channel 330 can have an oblong and/or oval cross-sectional shape. The oblong and/or oval cross-sectional shape of vertical adjustment channel 330 can provide a degree of lateral and/or horizontal movement within the channel for an element or component extending therethrough. In alternative embodiments, however, vertical adjustment channel 330 may have any suitable cross-sectional shape(s). For instance, vertical adjustment channel 330 may have a circular, rectangular, square, or any other geometric, rounded, or other cross-sectional shape or configuration.

Similarly, lateral adjustment channel 360 can extend from first side 309*a*, through the body portion of sight mounting member 306, and/or to second opposing side 309*b*. As depicted in the illustrated embodiment, for instance, lateral adjustment channel 360 extends a laterally and/or horizontally, entirely through the body portion of sight mounting member 306. In an alternative embodiment, however, lateral adjustment channel 360 may extend only partially through the body portion of sight mounting member 306.

As depicted, lateral adjustment channel 360 can have an oblong and/or oval cross-sectional shape. The oblong and/or oval cross-sectional shape of lateral adjustment channel 360 can provide a degree of vertical movement within the channel for an element or component extending therethrough. In alternative embodiments, however, lateral adjustment channel 360 may have any suitable cross-sectional shape(s). For instance, vertical adjustment channel 330 may have a circular, rectangular, square, or any other geometric, rounded, or other cross-sectional shape or configuration.

Figure 3B:
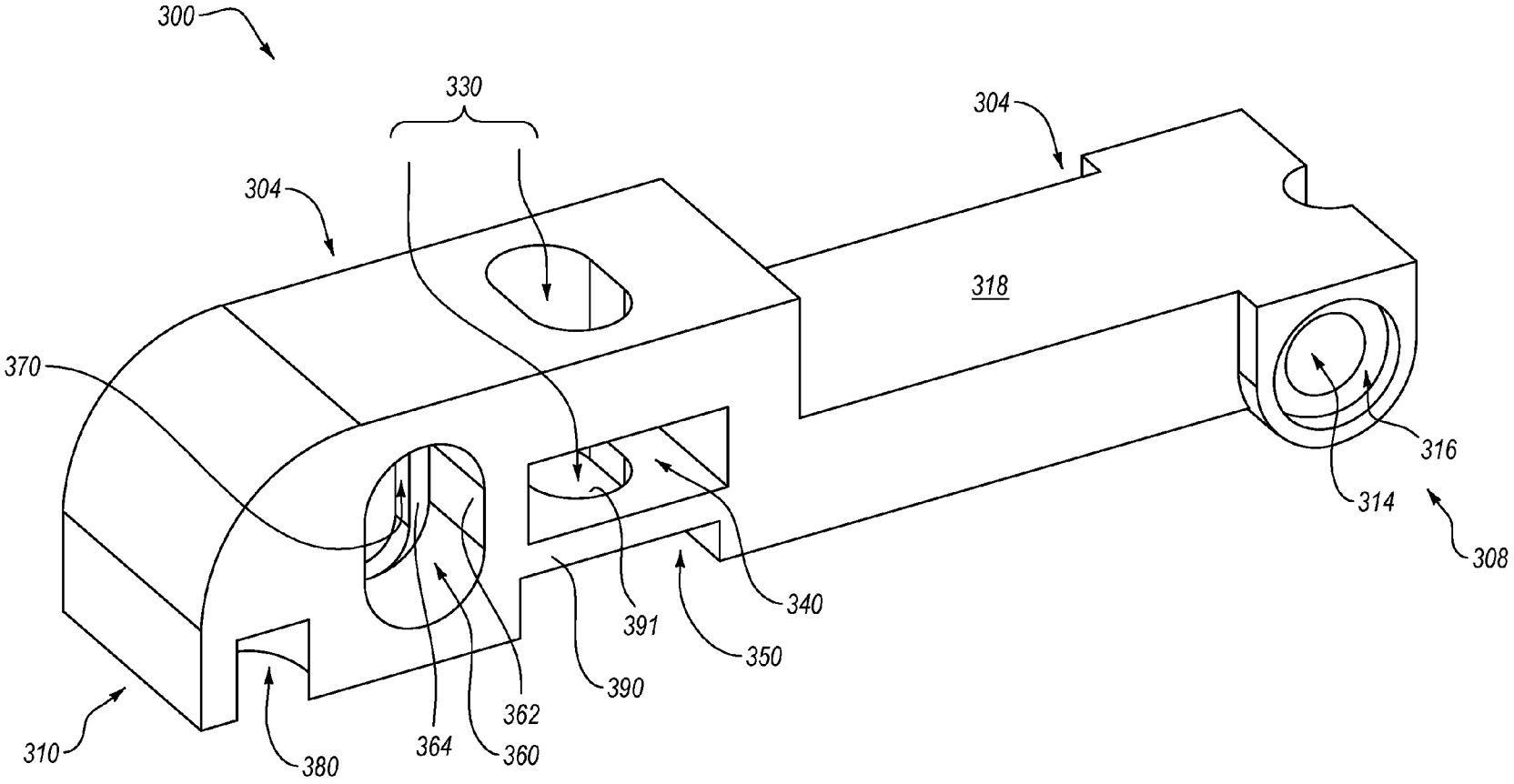
FIG. 3B illustrates a rear perspective view of the mounting element of FIG. 3A.
Figure 3C:
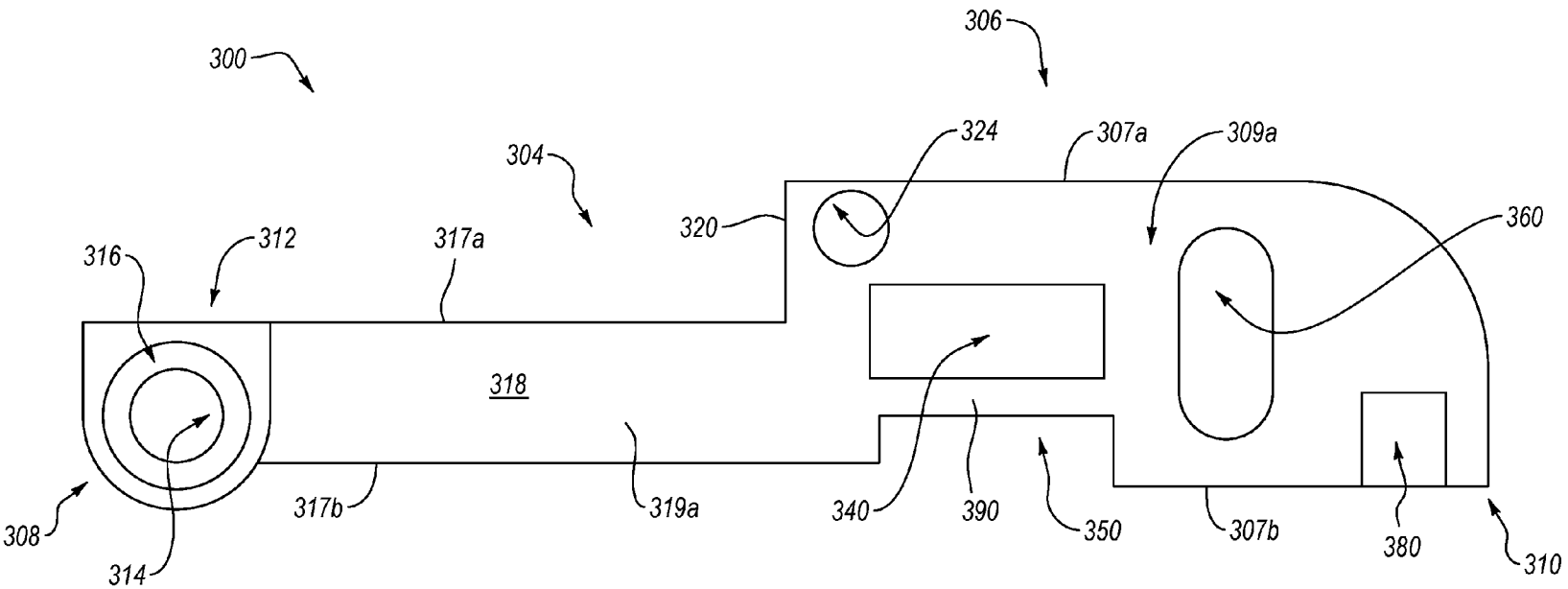
FIG. 3C illustrates a right side view of the mounting element of FIG. 3A.
Figure 3D:
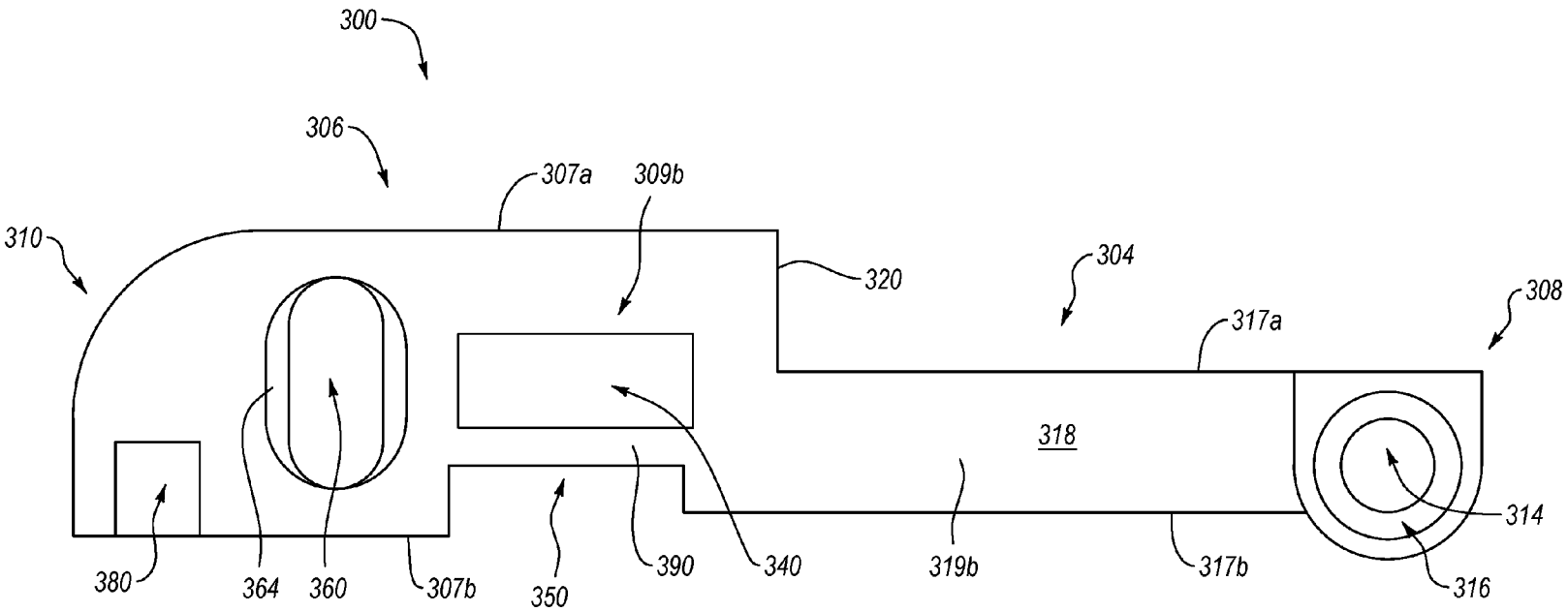
FIG. 3D illustrates a left side view of the mounting element of FIG. 3A.

As depicted in FIG. 3B, lateral adjustment channel 360 may have one or more lateral adjustment seats 364 disposed therein. As depicted in FIG. 3D, lateral adjustment seats 364 can extend to both sides of lateral adjustment channel 360. As described in further detail below, lateral adjustment seats 364 can be configured to receive and/or retain at least one biasing element (e.g., such that the at least one biasing element is substantially prevented from passing entirely through lateral adjustment channel 360).

Figure 3E:
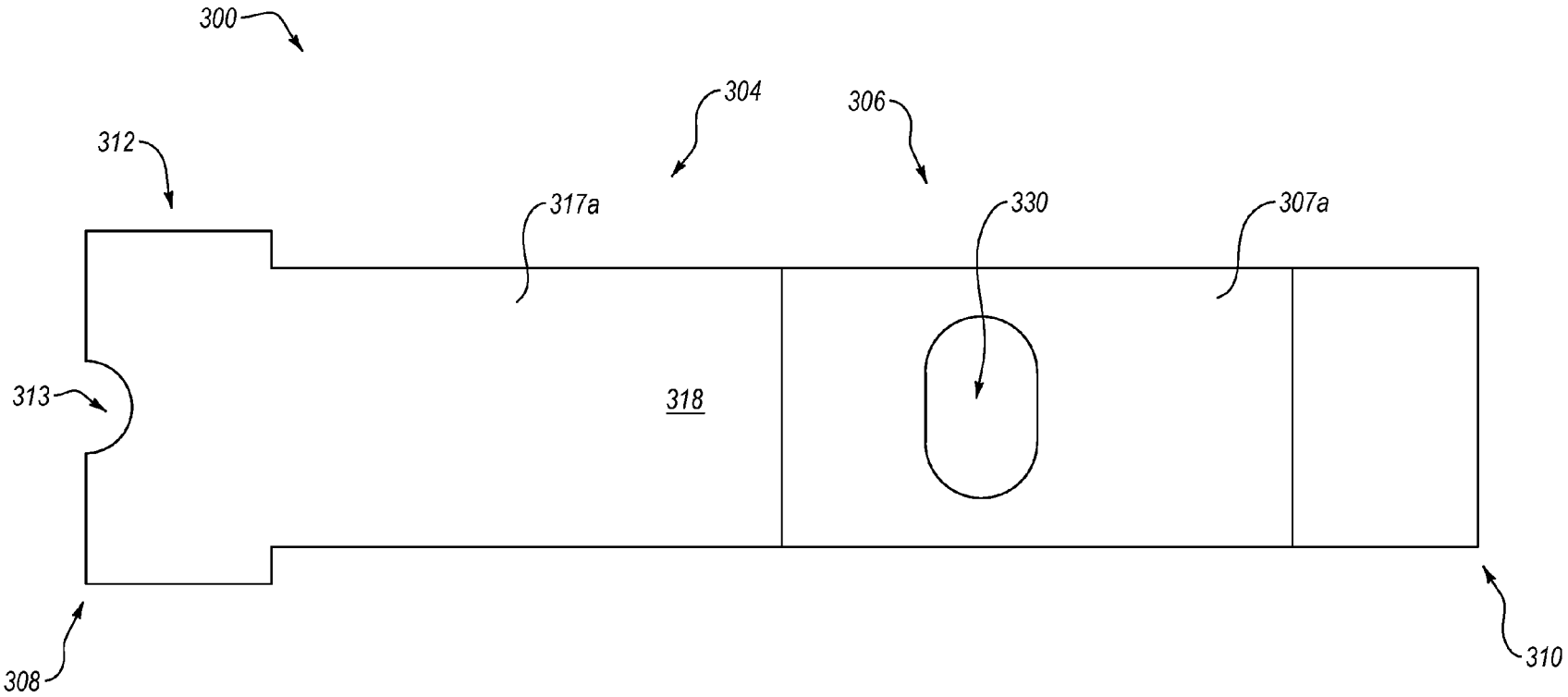
FIG. 3E illustrates a top plan view of the mounting element of FIG. 3A.
Figure 3F:
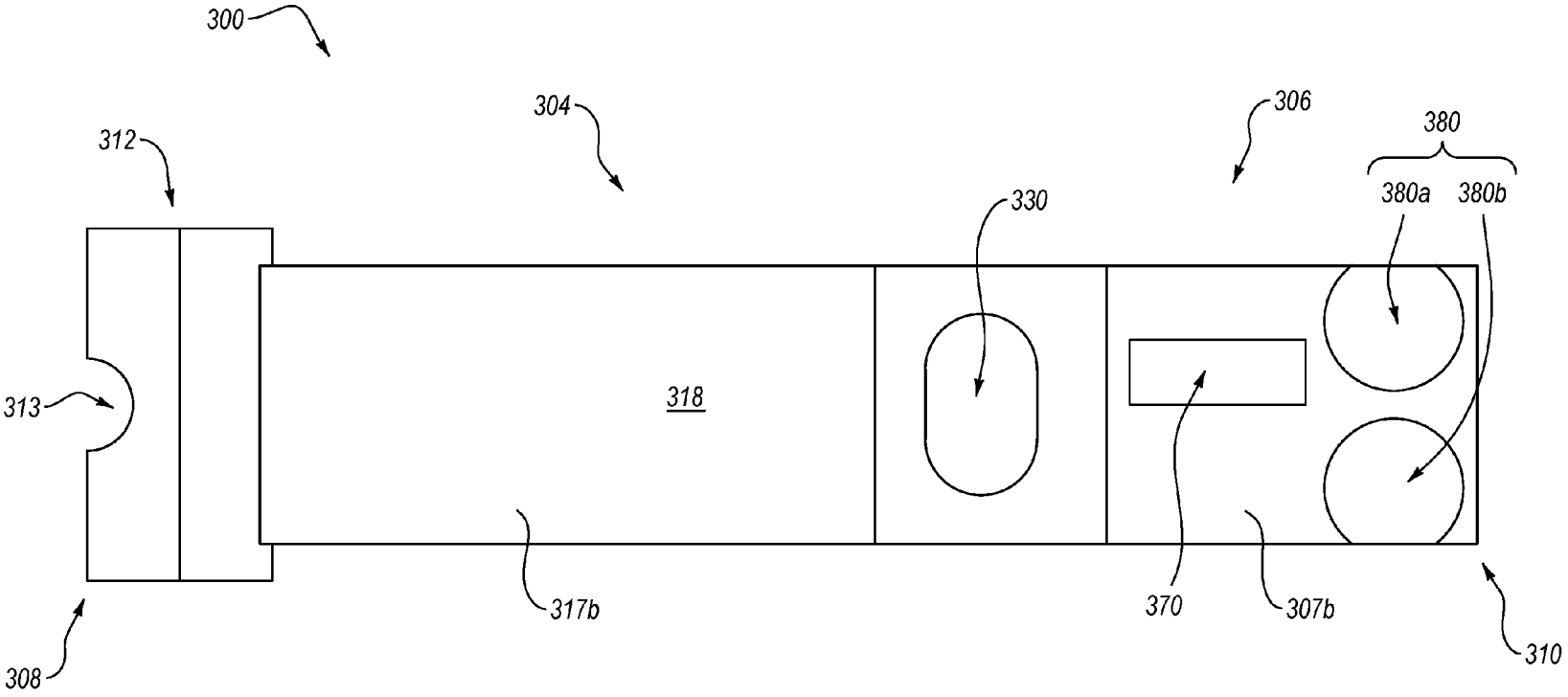
FIG. 3F illustrates a bottom plan view of the mounting element of FIG. 3A.
Figure 3H:
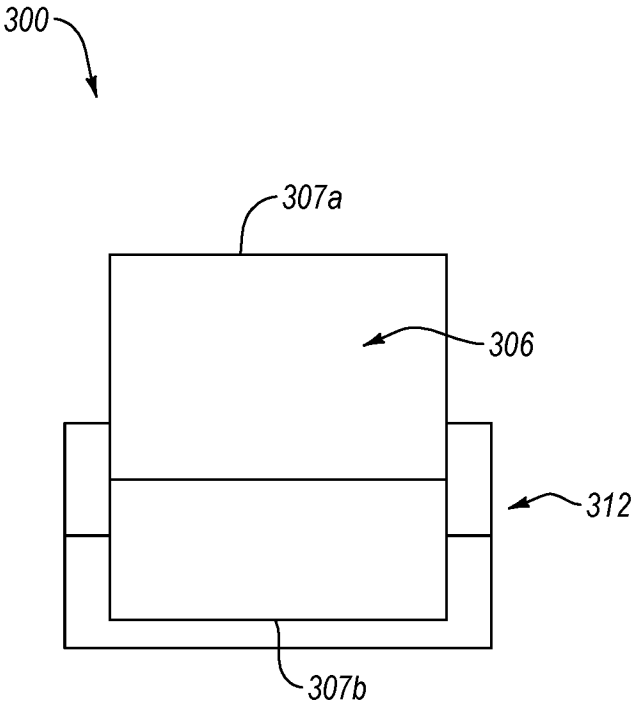
FIG. 3H illustrates a rear elevation view of the mounting element of FIG. 3A.
Figure 3G:
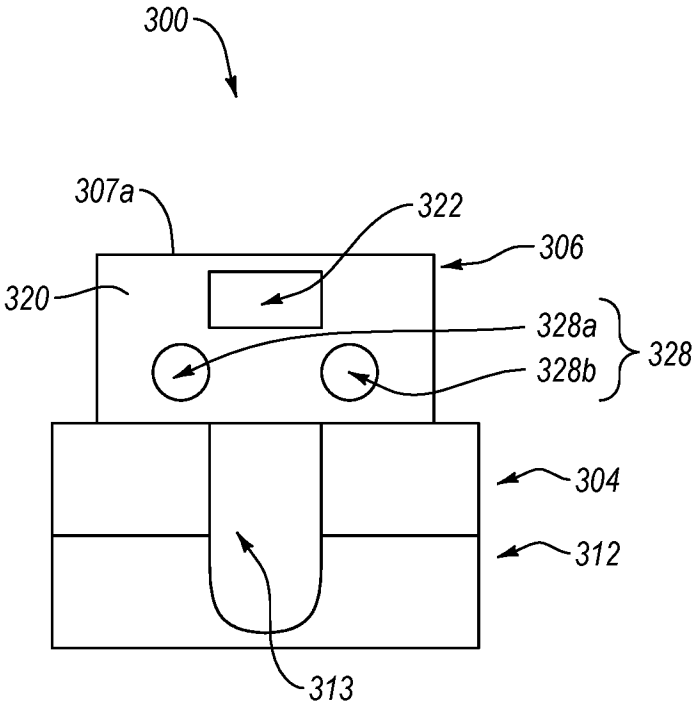
FIG. 3G illustrates a front elevation view of the mounting element of FIG. 3A.

Lateral adjustment channel 360 can also have one or more lateral adjustment sockets 370 disposed therein and/or extending (vertically) at least partially therethrough. For instance, as depicted in FIGS. 3A, 3B, and 3F, lateral adjustment socket 370 can extend from lower surface 307*b* of sight mounting member 306, into and/or through lateral adjustment channel 360. As illustrated in FIGS. 3A, 3B and 3E, however, lateral adjustment socket 370 may not extend entirely through the body portion of sight mounting member 306 and/or to upper surface 307*a* thereof. In at least one embodiment, and as depicted in FIG. 3F, lateral adjustment socket 370 can have a rectangle cross-sectional configuration. Accordingly, as described in further detail below, lateral adjustment socket 370 may be configured to receive a lateral adjustment component (e.g., square nut) or other fastener receiving element. It will be appreciated, however, that lateral adjustment channel 370 can have any suitable cross-sectional shape or configuration.

Vertical adjustment channel 330 can also have one or more vertical adjustment sockets 340 disposed therein and/or extending (laterally and/or horizontally) at least partially therethrough. For instance, as depicted in FIGS. 3A, 3C, and 3D, vertical adjustment socket 340 can extend (laterally and/or horizontally) from first side 309*a* to opposing second side 309*b* of sight mounting member 306. Thus, vertical adjustment socket 340 can extend (laterally and/or horizontally) entirely through the body portion of sight mounting member 306. In alternative embodiments, however, vertical adjustment socket 340 may extend only partially through the body of sight mounting member 306. For instance, vertical adjustment socket 340 may have a first opening at side 309*a*, but have a closed configuration at side 309*b*, or vice versa.

Vertical adjustment socket 340 can also have a rectangle cross-sectional configuration configured to receive a vertical adjustment component (e.g., square nut) or other fastener receiving element. It will be appreciated, however, that vertical adjustment channel 340 can have any suitable cross-sectional shape or configuration. In some embodiments, a support member 390 can be disposed between vertical adjustment socket 340 and mounting recess 350. Vertical adjustment channel 330 can extend (entirely) through support member 350 in certain embodiments.

Mounting element 300 can also include at least one vertical adjustment recess (or seat) 380. For instance, as illustrated in FIGS. 3A-3D and 3F, mounting element 300 can have opposing vertical adjustment seats 380 (e.g., at, near, or adjacent distal end 310). As described in further detail below, vertical adjustment seats 380 can be configured to receive and/or retain one or more biasing members (e.g., coiled springs).

In some embodiments, mounting element 300 can also include a proximal notch or recess 313. As discussed in further detail below, notch 313 can be configured to accommodate an attachment fastener (e.g., for securing sighting element 100 to a channel insert or surface of a support structure).

Figure 4C:
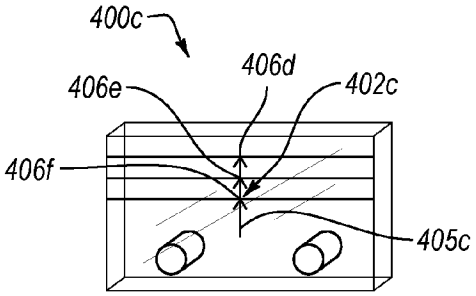
FIG. 4C illustrates a perspective view of another exemplary sighting element useful in forming the sighting device of FIG. 1A according to one embodiment of the present disclosure.
Figure 4B:
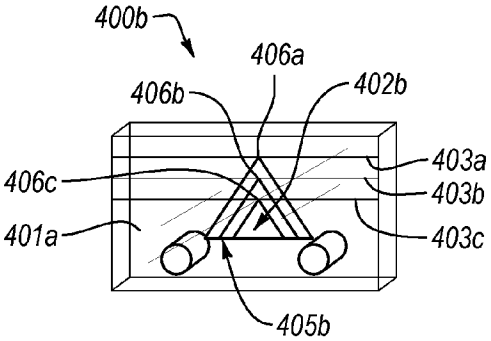
FIG. 4B illustrates a perspective view of another exemplary sighting element useful in forming the sighting device of FIG. 1A according to one embodiment of the present disclosure.
Figure 4A:
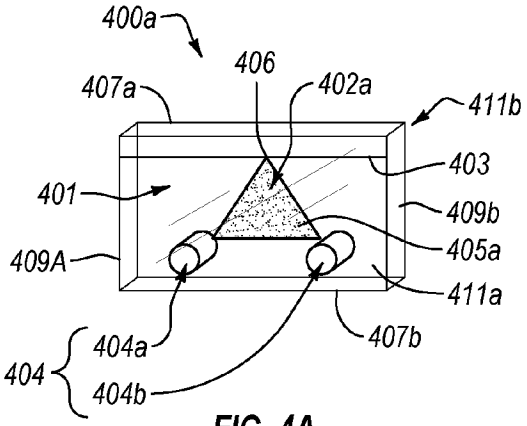
FIG. 4A illustrates a perspective view of an exemplary sighting element useful in forming the sighting device of FIG. 1A according to one embodiment of the present disclosure.

FIGS. 4A-4E depict exemplary configurations for a sighting element 400 according to various embodiments of the present disclosure. For instance, FIG. 4A illustrates a sighting element 400*a* comprising a body 401 with a reticle 402*a* disposed thereon or therein. As depicted in FIG. 4A, body 401 can have a substantially rectangular cross-sectional configuration. Body 401 can have an upper surface 407*a*, a lower surface 407*b*, a front surface 411*a*, a rear surface 411*b*, a first side surface 409*a*, and/or a second side surface 409*b*. At least a portion of body 401 can have a substantially uniform thickness, height, width, etc. It will be appreciated, however, that a variety of alternative shapes, sizes, and/or configurations are also contemplated herein. For instance, body 401 can have a rounded and/or non-uniform shape or configuration.

In at least one embodiment, body 401 can be or have a non-opaque (e.g., transparent or translucent) configuration. In contrast, reticle 402*a* can have an at least partially opaque configuration. Accordingly, reticle 402*a* can be visible on or through body 401 from one or more vantage points. In addition, light can pass and/or be transmitted through body 401 in some embodiments. For instance, a substantially opaque reticle 402*a* can be disposed on a front surface of body 401 such that light passing through an opposing back surface of body 401 can backlight reticle 402*a*.

As depicted in FIG. 4A, reticle 402*a* can comprise an alignment component 403. Alignment component 403 can comprise a (horizontal) line extending across at least a portion of body 401. In some embodiments, the line can be solid, dashed, dotted, and/or have any suitable gauge or thickness. Reticle 402*a* can also comprise sighting component 405*a*. As depicted in FIG. 4A, sighting component 405*a* can comprise a triangle. At least the outline of sighting component 405*a* can be or have an opaque configuration. In at least one embodiment, an upper tip or point of sighting component 405*a* can touch or otherwise contact alignment component 403. For instance, alignment component 403 can extend across the apex 406 of sighting component 405*a*.

Sighting element 400*a* and/or body 401 thereof can also have one or more attachment elements 404 (e.g., adapted for attaching sighting element 400*a* to mounting element 300). For instance, attachment element 404 can comprise an attachment opening 404*a*. In some embodiments, attachment element 404 can comprise opposing attachment openings 404*a* and 404*b*.

FIGS. 4B-4E depict sighting elements 400*b*-400*e*, respectively, according to embodiments of the present disclosure. Sighting elements 400*b*-400*e* can have configurations substantially similar to sighting element 400*a*, but with a variety of different reticles 402. For instance, as illustrated in FIG. 4B, reticle 402 can comprise three separate alignment components 403*a*, 403*b*, 403*c* and a sighting component 405*b* having three separate tips or points, each touching one of the alignment components 403*a*, 403*b*, 403*c*. For instance, reticle 402*b* can comprise three (at least partially overlapping) triangles. As depicted in FIG. 4B, each of the triangles can have a different size and/or height. Each of the alignment components 403*a*, 403*b*, 403*c* can extend across the apex 406 of one of the triangles.

Figure 4E:
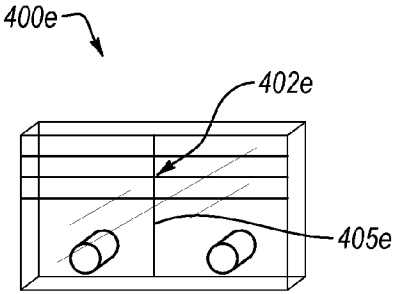
FIG. 4E illustrates a perspective view of another exemplary sighting element useful in forming the sighting device of FIG. 1A according to one embodiment of the present disclosure.
Figure 4D:
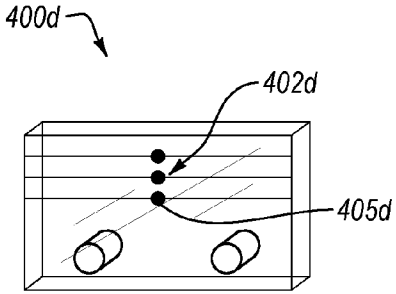
FIG. 4D illustrates a perspective view of another exemplary sighting element useful in forming the sighting device of FIG. 1A according to one embodiment of the present disclosure.

FIG. 4C illustrates that sighting component 405*c* can alternatively comprise one or more arrows or arrowheads. Accordingly, each of the alignment components 403*a*, 403*b*, 403*c* can extend across the point of the arrowheads. FIG. 4D illustrates that sighting element 405*d* can comprise one or more dots, and FIG. 4E illustrates that sighting element 405*d* can comprise one or more (vertical) lines. It will be appreciated, therefore, that reticle 402 can have any suitable configuration, including shapes, lines, images, etc. In certain embodiments, reticle 402 can comprise a crosshair or other vertical and horizontal targeting configuration.

Figure 5A:
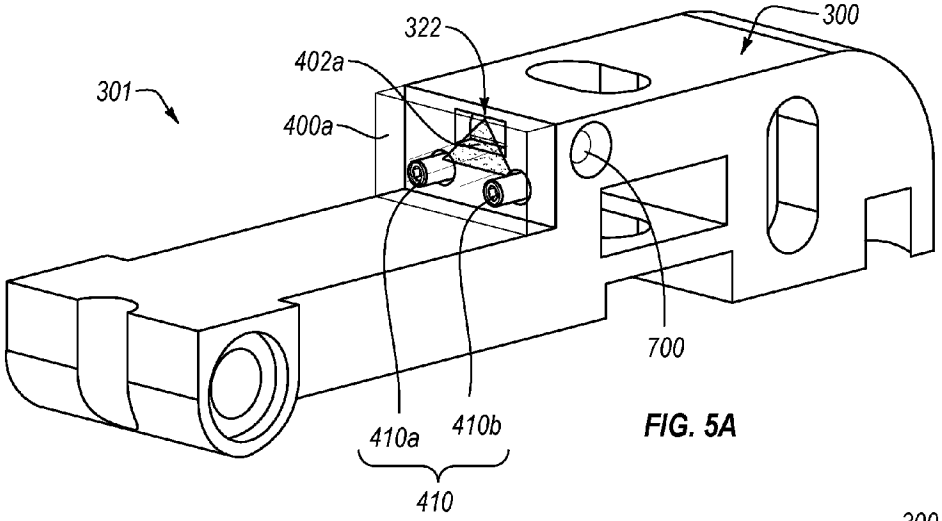
FIG. 5A illustrates a perspective view of an exemplary sighting assembly useful in forming the sighting device of FIG. 1A according to one embodiment of the present disclosure.
Figure 5B:
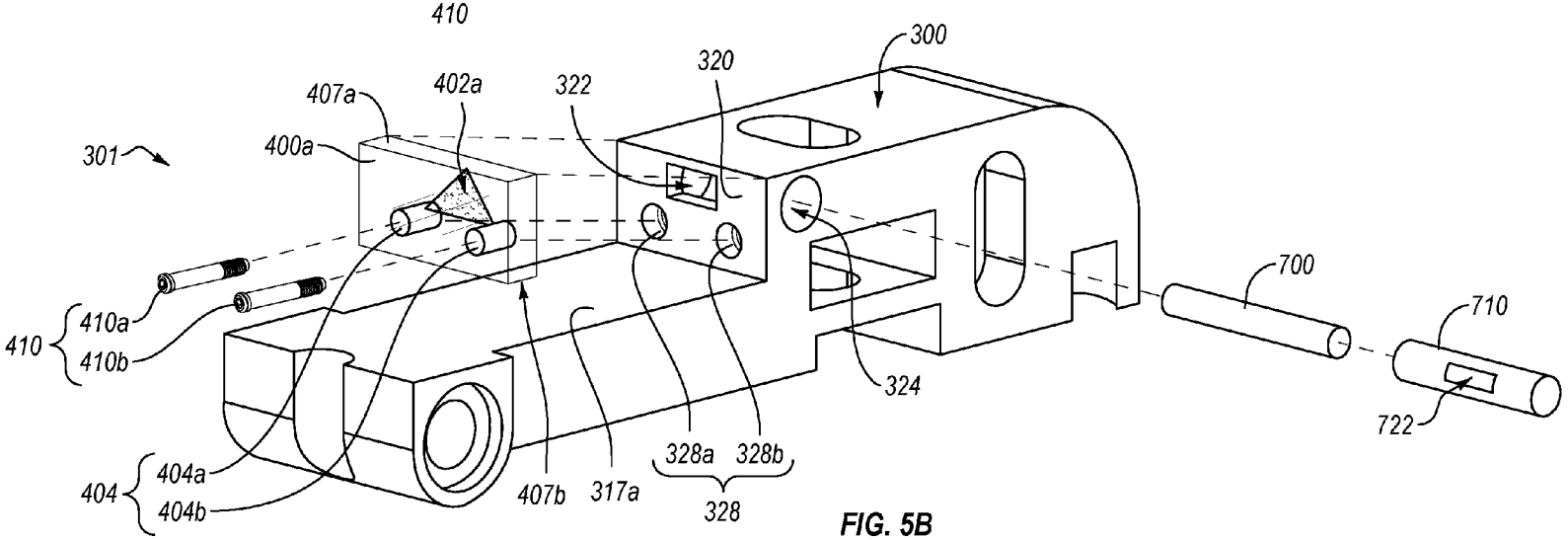
FIG. 5B illustrates an exploded perspective view of the sighting assembly of FIG. 5A.

FIGS. 5A and 5B illustrate a sighting assembly 301 according to an embodiment of the present disclosure. As depicted in FIGS. 5A and 5B, sighting element 400 (e.g., 400*a*) can be attached to mounting element 300 to form sighting assembly 301. For instance, sighting element 400*a* can be attached to mounting element 300 such that rear surface 411*b* of sighting element 400*a* is disposed against mounting surface 320, such that openings 404*a* and 404*b* are align with attachment openings 328*a* and 328*b*, respectively, and/or such that a bottom surface 407*a* of sighting element 400*a* is aligned with (e.g., rests on) an upper surface 317*a* of mounting element 300. An upper surface 407*a* of sighting element 400*a* can extend to, beyond, and/or adjacent to an upper surface 307*a* of mounting element 300. Side surface(s) 409*a*, 409*b* of sighting element 400*a* can also be aligned with side surface(s) 309*a*, 309*b*.

One or more fasteners 410 can attach sighting element 400*a* to mounting element 300. For instance, fastener 410 can comprise an adhesive, clamp, bracket, slot, or other mechanism for securing sighting element 400*a* to attachment surface 320. As depicted in FIGS. 5A and 5B, fastener 410 comprises attachment screws 410*a* and 410*b*, which can be inserted through attachment openings 404*a* and 404*b* and secured within attachment openings 328*a* and 328*b*. For instance, attachment screws 410*a* and 410*b* and attachment openings 328*a* and 328*b* can each have a threaded configuration.

As indicated above, sighting element 400*a* may also take any suitable shape or form, and may be selectively or permanently secured to the mounting element 300 in any suitable manner. For instance, according to one embodiment, the sighting element 400*a* may have a generally rectangular shape and be positioned against a substantially flat mounting surface 320 formed on mounting element 300. The shape and size of sighting element 400*a* may generally correspond to the shape and size of mounting surface 320. Sighting element 400*a* may be secured therein by any suitable mechanism, including at least an interference fit, adhesive, mechanical fastener, or other device, or a combination thereof. In some embodiments, sighting element 400*a* can be selectively removable. For instance, sighting element 400*a* may be selectively removable so as to allow replacement to accommodate differences in types of devices or firearms, different ranges of use, different ballistics, or the like.

Sighting element 400*a* can also be attached to mounting element 300 such that window 322 is disposed behind sighting element 400*a* (when viewed from the first vantage point). An illuminating element 700 can be inserted into channel 324 such that illuminating element 700 is disposed within channel 324 and/or visible through window 322. Light emitted from illuminating element 700 can, therefore, backlight sighting element 400*a* and/or reticle 402*a* disposed thereon or therein (from the first vantage point).

Illuminating element 700 can comprise any suitable light-emitting component. For instance, illuminating element 700 can comprise a radioisotope (e.g., tritium) in at least one embodiment. Other illuminating elements, isotopes, and/or light-emitting components, including those known in the art, are also contemplated herein (e.g., for backlighting sighting element 400*a* and/or reticle 402*a*).

In one or more embodiments, a sheath or sleeve 710 can be disposed about illuminating element 700. Sheath or sleeve 710 can comprise a reflective material that reflects at least a portion of the light emitted by illuminating element 700. Sheath or sleeve 710 can also have an opening or window 722. In at least one embodiment, opening 722 can be aligned with window 322 such that light reflected by sheath or sleeve 710 is directed and/or focused at least partially through aligned windows 722 and 322 (e.g., to enhance the illumination of sighting element 400*a* and/or reticle 402*a*).

As indicated above, in at least one embodiment, sight mounting member 306 can be substantially opaque or have a substantially opaque configuration. Accordingly, illuminating element 700 may not be visible through sight mounting member 306 (e.g., from the second vantage point and/or one or more additional vantage points). Thus, in the case of a target capable of light perception, embodiments of the present disclosure may not alert such a target of the aimed sighting device.

As illustrated in FIGS. 6A-6D, sighting assembly 301 can be attached and/or secured to base 200 to form sighting device 100 (e.g., as depicted in FIGS. 1A-1B). Specifically, sighting assembly 301 can be inserted and/or received into and/or within receiving area 203. Various openings, apertures, channels, and/or other components can be aligned between sighting assembly 301 and base 200. For instance, attachment channel 314 of mounting element 300 can be aligned with attachment aperture 224 and/or attachment opening 226.

Figure 6A:
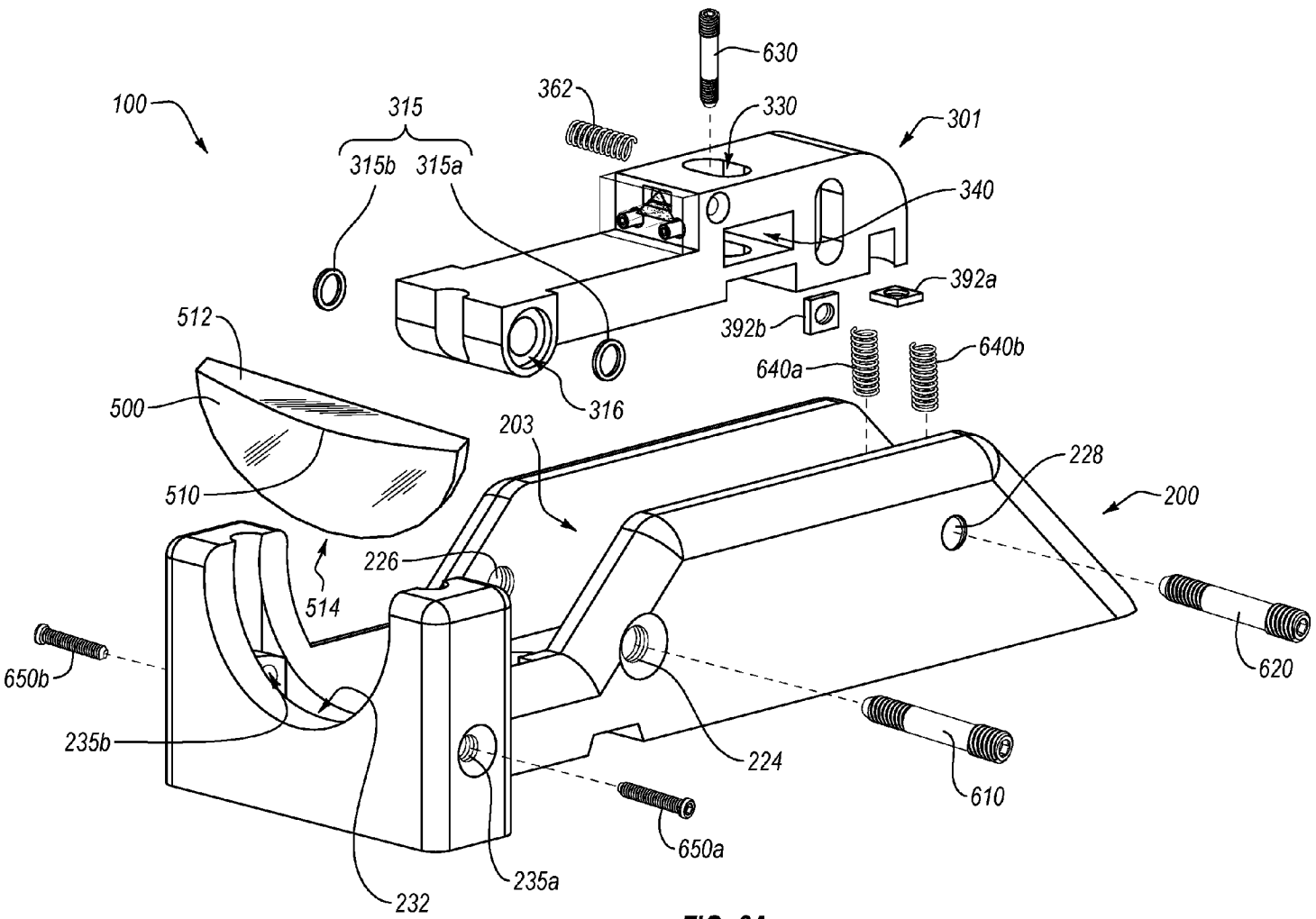
FIG. 6A illustrates an exploded, right side perspective view of the sighting device of FIG. 1A.
Figure 6B:
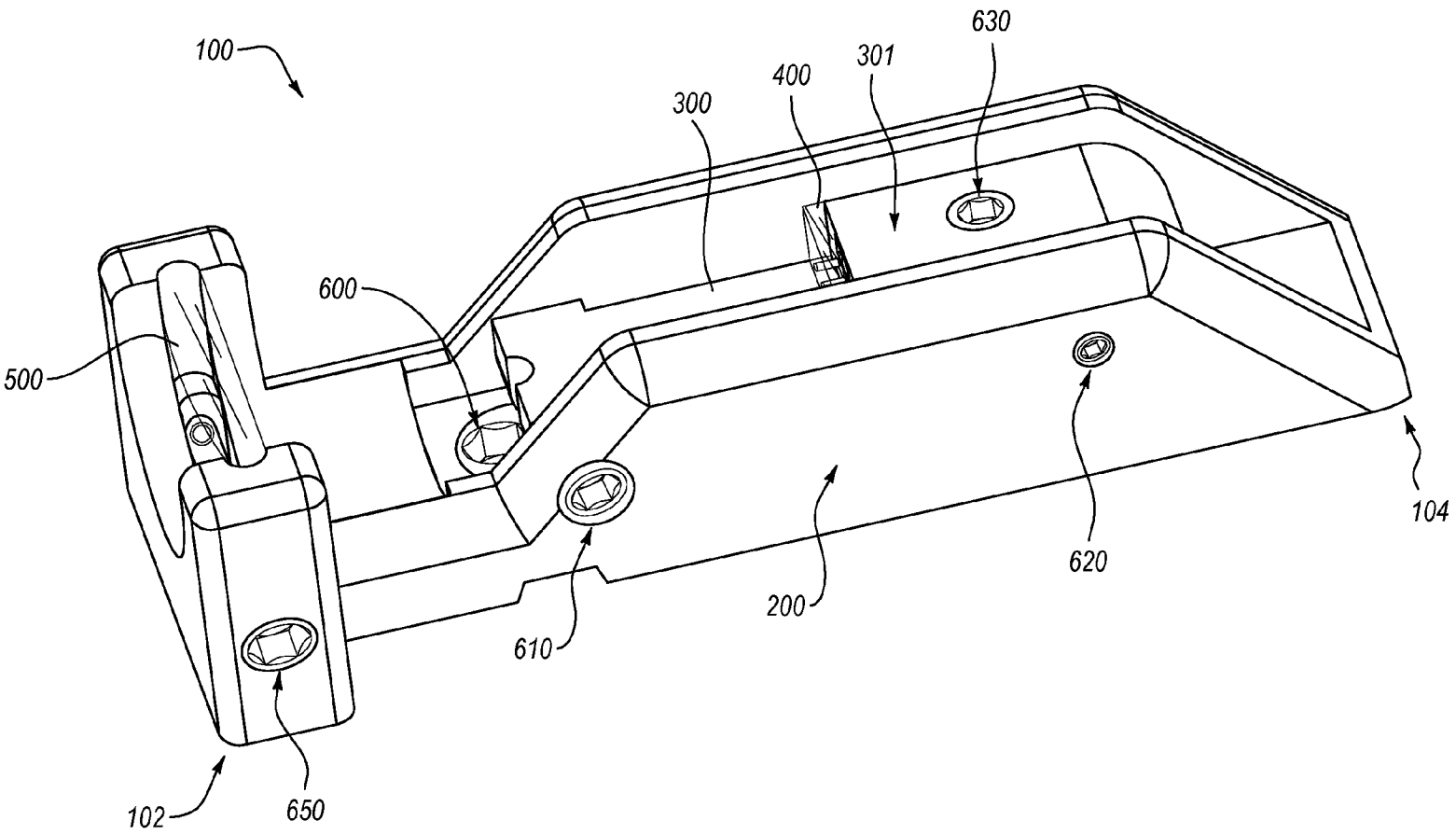
FIG. 6B illustrates an exploded, top perspective view of the sighting device of FIG. 1A.
Figure 6C:
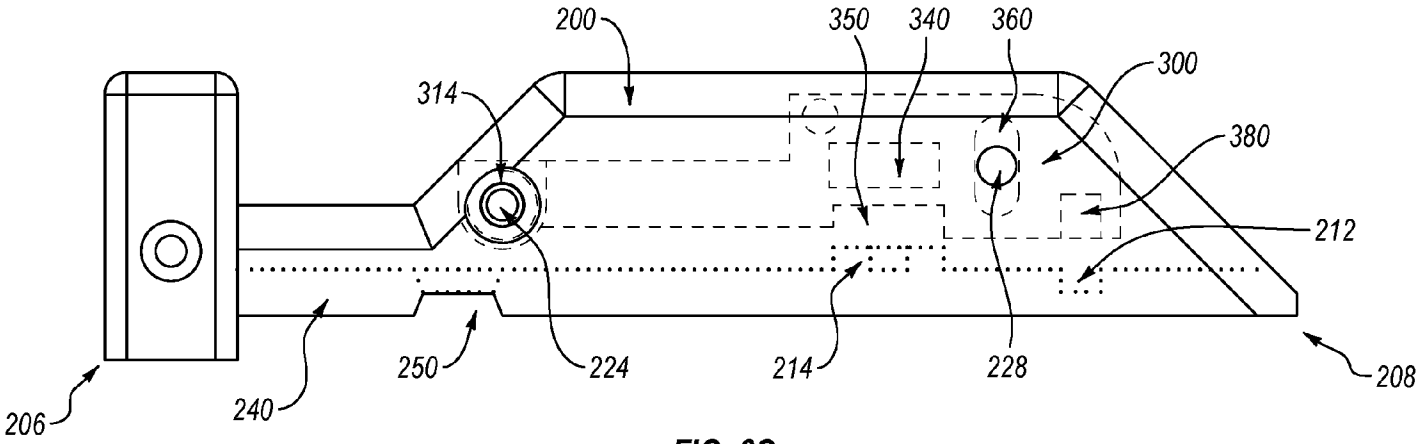
FIG. 6C illustrates a schematic side view of the sighting device of FIG. 1A.

In some embodiments, a cushioning member 315 can be disposed at, in, or near channel seat(s) 316. Cushioning member 315 can comprise an elastomeric (e.g., rubber, polymeric, etc.) gasket configured to fit in channel seat 316. As depicted in FIGS. 6A-6B, for instance, cushioning member 315 can comprise an O-ring. A fastener 610 can be inserted through the aligned attachment aperture 224, attachment channel 314, optional cushioning member(s) 315, and/or attachment opening 226 to (pivotably) secure sighting assembly 301 to base 200 (as shown in FIG. 1A). Thus secured, sighting assembly 301 can (substantially vertically) pivot (up and down) within receiving area 203, about attachment channel 314, and/or about the attachment interface associated therewith. In addition, cushioning member(s) 315 can permit a certain degree of lateral movement of sighting assembly 301 within receiving area 203, about attachment channel 314, and/or about the attachment interface associated therewith. For instance, thus secured, sighting assembly 301 can flex toward either of side walls 220, 222 upon application of a force there toward. Upon removal of the force, sighing assembly 301 can return to a (substantially central or centered) default position within receiving area 203.

Mounting recess 350 of mounting element 300 can also be aligned with vertical adjustment mount 214 (e.g., such that vertical adjustment channel 330 of mounting element 300 is aligned with vertical adjustment opening 216 of base 200). A fastener 630 can be inserted through the aligned vertical adjustment channel 330 and vertical adjustment opening 216 (e.g., such that sighting assembly 301 is vertically-adjustably secured to base 200 (at vertical adjustment mount 214)). Specifically, vertical biasing member(s) 640 can be disposed at least partially between sighting assembly 301 and base 200. For instance, vertical biasing member(s) 640 can be disposed within vertical adjustment seat(s) 212*a*, 212*b* and/or vertical adjustment recess(es) 380 thereby biasing sighting assembly 301 away from base 200. In at least one embodiment, vertical biasing member(s) 640 can comprise a coil or spring.

Fastener 630 can be configured to overcome biasing member(s) 640 and/or bring sighting assembly 301 into (closer) proximity with base 200. For instance, fastener 630 can have one or more threaded portions. A first threaded portion can be threadedly inserted into a threaded vertical adjustment opening 216 (e.g., to attach and/or secure sighting assembly 301 to base 200 at or near distal end 208 thereof). A second threaded portion can be threadedly inserted into a vertical adjustment component 392*a* (e.g., disposed within vertical adjustment socket 340). In at least one embodiment, vertical adjustment component 392*a* can comprise a threaded (square) nut or other fastener receiving element.

Lateral adjustment channel 360 can also be aligned with lateral adjustment opening 228. A fastener 620 can be inserted through the aligned lateral adjustment channel 360 and lateral adjustment opening 228 (e.g., such that sighting assembly 301 is laterally-adjustably secured to base 200. Specifically, a lateral biasing member(s) 362 can be disposed at least partially between sighting assembly 301 and base 200. For instance, lateral biasing member(s) 362 can be disposed within, between, and/or adjacent to lateral adjustment channel 360 and lateral adjustment opening 228 (thereby biasing sighting assembly 301 away from side wall 220 of base 200).

In an alternative embodiment, lateral biasing member(s) 362 can be disposed at, in, or near lateral adjustment channel 360. For instance, lateral biasing member(s) 362 can be disposed at, in, or near lateral adjustment seat 364 (e.g., between lateral adjustment seat 364 and side wall 222, thereby biasing sighting assembly 301 away from side wall 222 of base 200. In at least one embodiment, lateral biasing member 362 can comprise a coil or spring.

Fastener 620 can be configured to overcome lateral biasing member(s) 362 and/or bring sighting assembly 301 into (closer) proximity with side wall 220 and/or 222 of base 200. For instance, fastener 620 can have one or more threaded portions. A first threaded portion can be threadedly inserted into a threaded lateral adjustment opening 228 (e.g., to attach and/or secure sighting assembly 301 to base 200 at or near distal end 208 thereof). A second threaded portion can be threadedly inserted into a lateral adjustment component 392*b* (e.g., disposed within lateral adjustment socket 360). In at least one embodiment, lateral adjustment component 392*b* can comprise a threaded (square) nut or other fastener receiving element.

The assembled sighting device 100 (illustrated in FIGS. 1A and 6B, for example) can be adjusted for accuracy at various ranges and/or distances. For instance, vertical adjustment mechanism 630 can be rotated to raise or lower distal end 310 of mounting element 300 within receiving area 203 and/or relative to base 200. In addition, the lateral position of mounting element 300 within receiving area 203 and/or relative to base 200 can be altered by rotating lateral adjustment mechanism 620.

In at least one embodiment, for instance, fastener 630 can comprise bifurcated threads in certain embodiments. A first, larger threaded portion may be disposed at a first portion of fastener 630 and a second, smaller threaded portion may be disposed at a second portion of fastener 630. Likewise, vertical adjustment component 392*a* can comprise a first threaded opening (having a first size) and vertical adjustment opening 216 can comprise a second threaded opening (having a second size). With vertical adjustment component 392*a* disposed within vertical adjustment channel 340, and fastener 630 extending therethrough and threadedly engaging both vertical adjustment component 392*a* and vertical adjustment opening 216, rotation of fastener 630 in a first direction can overcome biasing member(s) 640*a*, 640*b* and bring sighting assembly 301 closer to base 200.

Fastener 620 can also comprise bifurcated threads configured to engage with a first threaded opening (in lateral adjustment component 392*b*) and a second threaded opening (lateral adjustment opening 228), in some embodiments. Similar rotation of fastener 620 can overcome biasing member(s) 362, causing lateral adjustment of distal end 310 of mounting element 300 relative to base 200. Fastener 610 can also comprise bifurcated threads configured to engage with a first threaded opening (attachment aperture 224) and a second threaded opening (attachment opening 226), in some embodiments. Similar rotation of fastener 610 can cause lateral adjustment of proximal end 308 of mounting element 300 relative to base 200.

FIGS. 6A-6D further illustrates that optical component 500 can be inserted into recessed portion 232 and/or secured therein by means of one or more fasteners 650. Optical component 500 can comprise at least one convex surface 510 and/or a substantially flat upper surface 512. In some embodiments, optical component 500 can also have a rounded bottom 514.

Optical component 500 may also be selectively removable. For instance, in the event that optical component 500 is scratched, broken, or otherwise damaged, the optical component 500 may be removed and replaced. In other embodiments, base 200 may include multiple optic receiving elements 230 and/or recessed portions 232, each of which may accommodate a different type or configuration of optical component 500, or be positioned to allow for accuracy at different ranges.

Figure 6D:
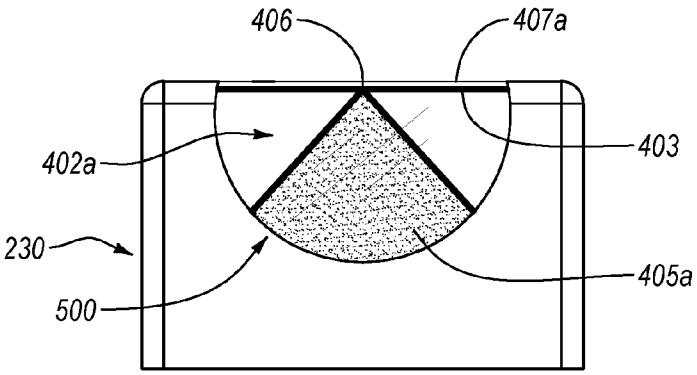
FIG. 6D illustrates a front elevation view of the sighting device of FIG. 1A.

As illustrated in FIG. 6D, optical component 500 can magnify reticle 402*a* when viewed from the first vantage point (as depicted in FIG. 6D). Specifically, optical component 500 can magnify alignment element 403 and/or sighting component 405*a* so as to increase the accuracy of sighting and/or targeting.

Figure 7A:
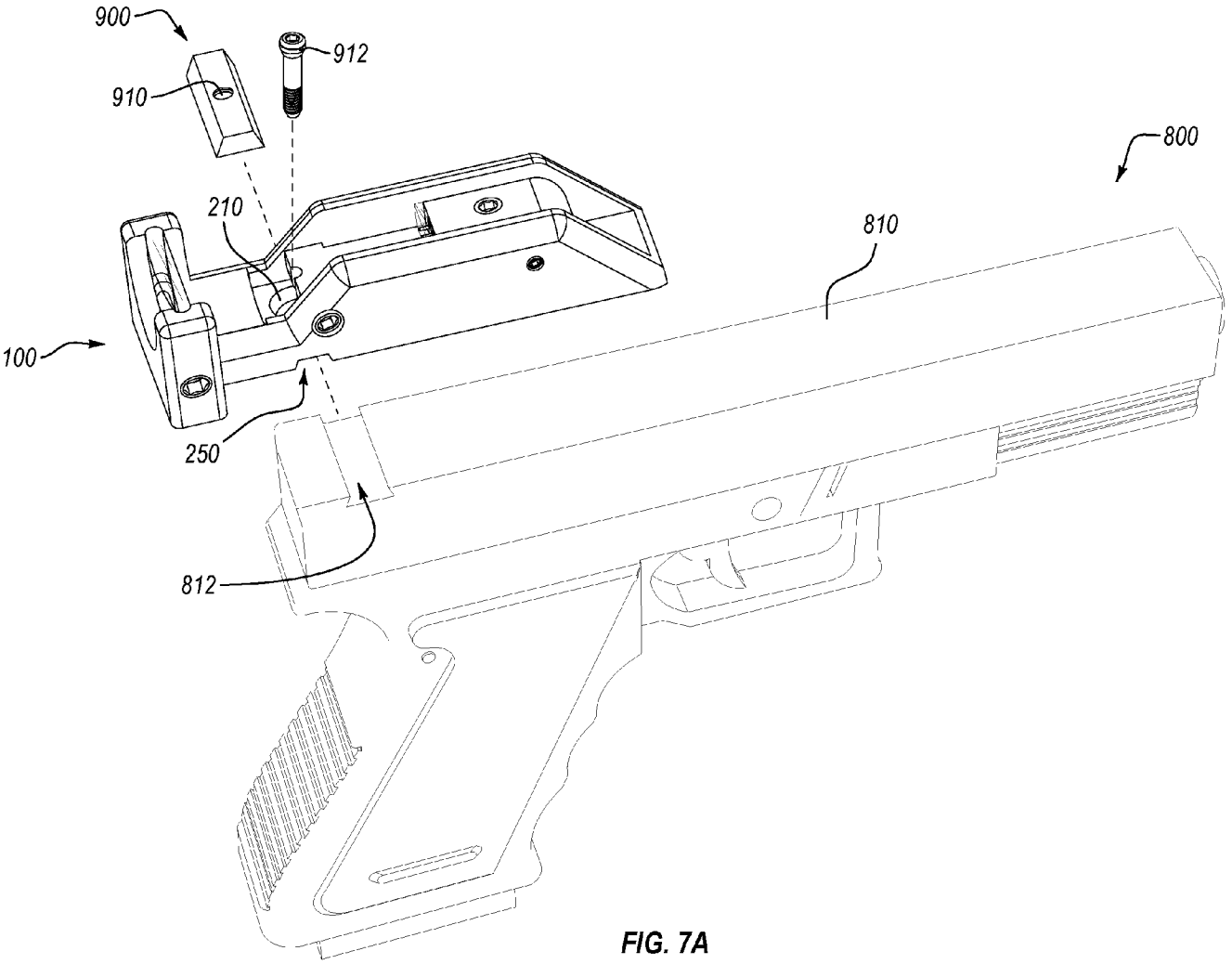
FIGS. 7A-7C illustrate a method of mounting the sighting device of FIG. 1A to a surface of a support structure according to one embodiment of the present disclosure.
Figure 7B:
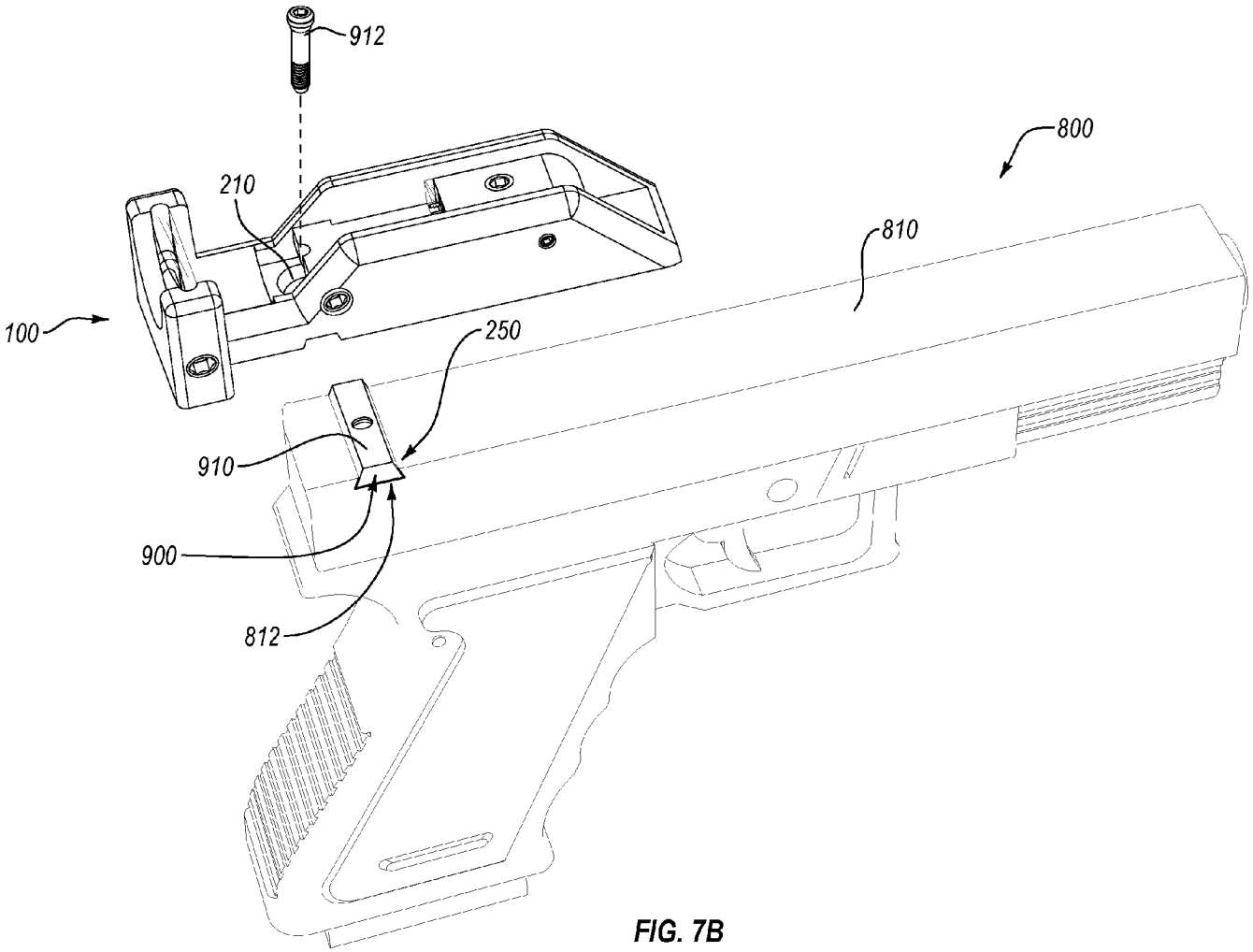
Figure 7C:
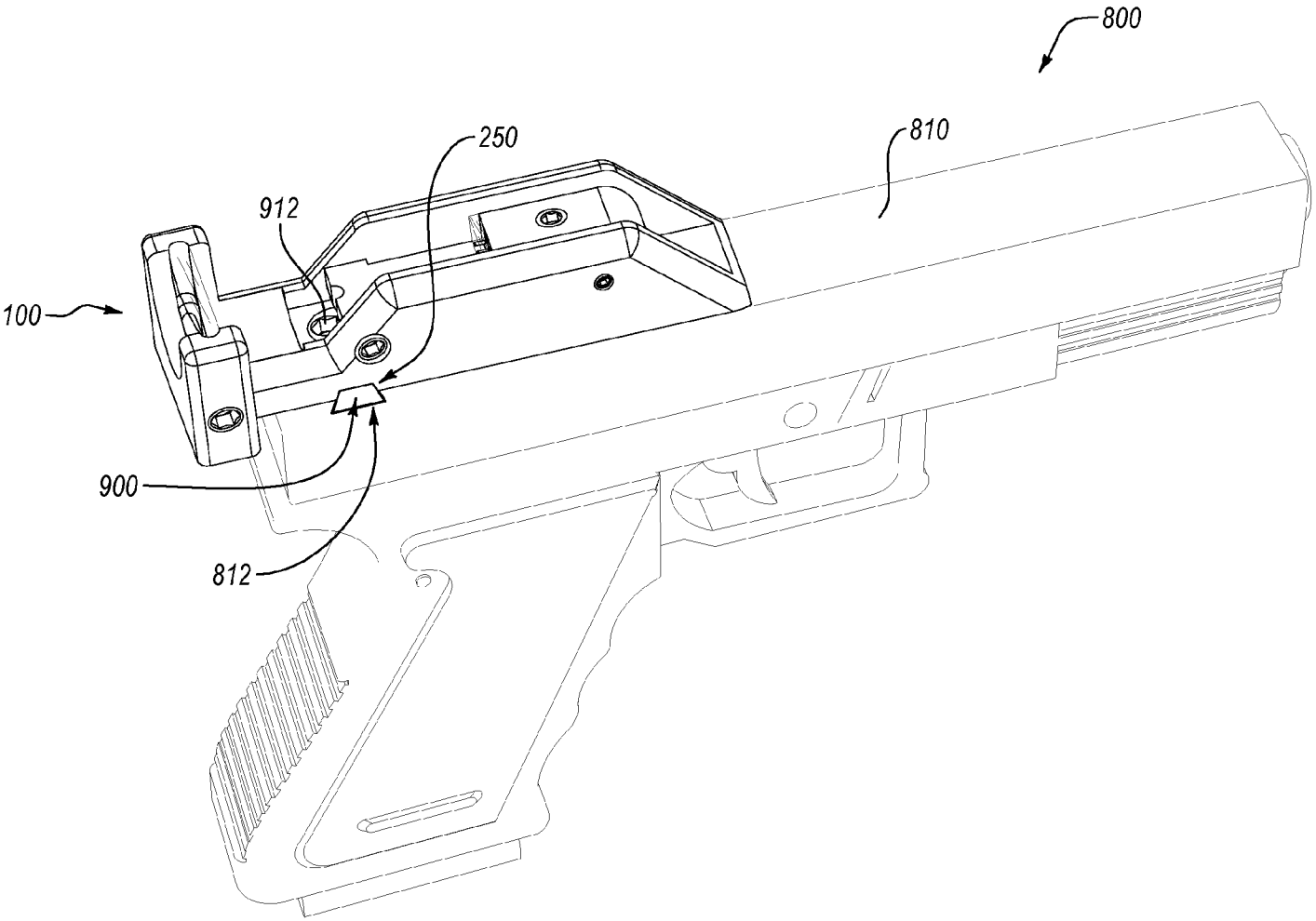

FIGS. 7A-7C illustrate attachment of sighting device 100 to a surface 810 of a support structure 800 according to one embodiment of the present disclosure. As depicted in FIGS. 7A-7C, support structure 800 can comprise a handgun or pistol. It will be appreciated, however, that support structure

800 can comprise any suitable type of firearm. In addition, sighting device 100 can be attached to various non-firearm support structures without departing from the scope of this disclosure.

As depicted in FIGS. 7A-7C, surface 810 of support structure 800 comprises a channel 812. An attachment element 900 (which can be formed of a stainless, carbon, or other hardened steel or metal) can be inserted into channel 812. Channel 812 and attachment element 900 can have corresponding cross-sectional shapes and/or configurations. Accordingly, once inserted within channel 812, attachment element 900 can be substantially secured therein. For instance, channel 812 and attachment element 900 can each have a trapezoidal cross-sectional shape or configuration (e.g., thereby forming a dovetail interface). In at least one embodiment, attachment element 900 can be sized so as to fit snuggly and/or securely within channel 812. Accordingly, a substantial force (e.g., pressure and/or impact) may need to be applied in order for attachment element 900 to be inserted into channel 812. In certain embodiments, one or more optional set screws can be inserted into and/or through attachment element 900 to secure attachment element 900 within channel 812.

With attachment element 900 thus secured within channel 812, sighing element 100 can be attached and/or secured to support structure 800. For instance, securing channel 250 of base 200 can be aligned with attachment element 900 (secured within channel 812). Specifically, sighting element 100 can be placed on surface 810 of support structure 800 such that attachment element 900 is inserted into securing channel 250. Fastener 912 can be inserted through securing aperture 210 and into an opening 910 in attachment element 900. In at least one embodiment, fastener 912 and opening 910 can comprise corresponding threaded portions, respectively.

In some embodiments, fastener 912 can resist, inhibit, and/or substantially prevent movement of sighting device 100 atop support structure 800. For instance, fastener 912 can resist, inhibit, and/or substantially prevent vertical (upward) and/or 8 lateral (sideways) movement of sighting device 100 about surface 810. In addition, the interface between attachment element 900 and channels 812 and 250, respectively, can resist, inhibit, and/or substantially prevent lateral rotational (twisting) movement of sighting device 100 about surface 810.

Thus secured to support structure 800, sighting device 100 can comprise an aiming mechanism configured to sight or aim a projectile ejected from support structure 800. For instance, sighting device 100 can be configured to provide an accurate indication of where a bullet or other projectile(s) shot from a firearm is likely to impact a target. Returning briefly to FIG. 6D, for instance, alignment component 403 can be aligned with the upper surface 512 of optical component 500 (e.g., such that alignment component 403 is barely visible or not visible through optical component 500 when viewed from the first vantage point). Accordingly, the apex or peak 406 of sighting component 405*a* of reticle 402*a* can be aligned with upper surface 512 of optical component 500. The apex or peak 406 of sighting component 405*a*, thus aligned, can provide the aforementioned accurate indication in certain embodiments.

Those skilled in the art will appreciate that where reticle 402*b*, 402*c*, 402*d*, 402*e* provides a plurality of sighting components 405 and/or peaks 406 thereof (e.g., as depicted in FIGS. 4B-4E) such peaks and/or apexes 406 can provide an accurate indication of where a bullet or other projectile(s) shot from a firearm is likely to impact targets at a plurality of ranges. Furthermore, optical component 500 and sighting element 400 are generally illustrative of any of a number of different types of optics and/or sights (e.g., sighting mechanisms) that may be employed in a sighting device according to the present disclosure (e.g., sighting device assembly 100).

As also shown in the figures, sighting device 100 according to the certain embodiments of the present disclosure may effectively operate as an open sight. In particular, in the illustrated embodiments, sighting device 100 may be used by aligning the upper surface of the exemplary optical component 500 with a target and sighting component 405 of reticle 402.

In some embodiments, optical component 500, sighting element 400, and/or reticle 402 do not need to be contained within a tube or chamber, or otherwise enclosed, and can thus provide the benefits of open sights, such as low cost, simplicity of use, and light weight. Moreover, the optical and reticle components of the disclosed embodiments can improve accuracy by not only providing a similar size, weight, cost, or other features, or combinations thereof, of an open sight, but while also providing accuracy comparable to those of crosshairs in a scope device. Indeed, one aspect of some embodiments of the present disclosure is that the sight remains open, thereby allowing the benefits of an open sight (e.g., weight, size, ability to holster a pistol, etc.). While providing the benefits of an open sight, sights described herein nevertheless also provide nearly the same accuracy as a scope. Accordingly, potentially the best features of open sights and a scope can be combined into a single sighting device.

In some optional aspects, the sighting device 100 may also include one or more adjustment mechanisms by which the sighting device 100 may be adjusted or manipulated so as to improve accuracy. For instance, the sighting device 100 may be adjusted for use with one type of firearm or projectile, and then re-calibrated or adjusted to accurately sight a second type of firearm or projectile.

The foregoing detailed description makes reference to specific exemplary embodiments. However, it will be appreciated that various modifications and changes can be made without departing from the scope contemplated herein and as set forth in the appended claims. For example, various optical sighting devices and components may have different combinations of sizes, shapes, configurations, features, and the like. Such differences described herein are provided primarily to illustrate that there exist a number of different manners in which optical sighting devices may be used, made, and modified within the scope of this disclosure. Different features have also been combined in some embodiments to reduce the illustrations required, and are not intended to indicate that certain features are only compatible with other features. Thus, unless a feature is expressly indicated to be used only in connection with one or more other features, such features can be used interchangeably on any embodiment disclosed herein or modified in accordance with the scope of the present disclosure. The detailed description and accompanying drawings are thus to be regarded as merely illustrative, rather than as restrictive, and all such modifications or changes, if any, are intended to fall within the scope of this disclosure.

More specifically, while illustrative exemplary embodiments in this disclosure have been more particularly described, the present disclosure is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description, which examples are to be construed as non-exclusive. Moreover, any steps recited in any method or process described herein and/or recited in the claims may be executed in any order and are not limited to the order presented in the claims, unless otherwise stated in the claims. Accordingly, the scope of the invention should be determined solely by the appended claims and their legal equivalents, rather than by the descriptions and examples given above.

What is claimed is:

1. A backlit sighting device, comprising:

an illuminating element;

a sighting element comprising a non-opaque body and at least one reticle disposed on or in the body such that the at least one reticle is visible when viewed from a first vantage point, the illuminating element being disposed behind the at least one reticle when viewed from the first vantage point such that light produced by the illuminating element passes through at least a portion of the body backlighting the at least one reticle when viewed from the first vantage point;

a mounting element, the sighting element being connected to the mounting element; and a base coupled to the mounting element, the base comprising a first connection component for coupling the base to a surface of a support structure at a first interface and a second connection component for coupling the mounting element to the base at a second interface.

2. The sighting device of claim 1, wherein the illuminating element comprises a self-illuminating radio-isotope.

3. The sighting device of claim 2, wherein the illuminating element comprises tritium.

4. The sighting device of claim 1, wherein the illuminating element is disposed at least partially within the body of the sighting element.

5. The sighting device of claim 1, wherein the mounting element comprises a non-opaque body.

6. The sighting device of claim 1, wherein the mounting element includes an opaque body disposed behind the illuminating element when viewed from the first vantage point.

7. The sighting device of claim 1, wherein the illuminating element is disposed on or in a portion of the mounting element.

8. A backlit sighting device, comprising:

an illuminating element;

a sighting element comprising a non-opaque body and at least one reticle disposed on or in the body such that the at least one reticle is visible when viewed from a first vantage point, the illuminating element being disposed behind the at least one reticle when viewed from the first vantage point such that light produced by the illuminating element passes through at least a portion of the body backlighting the at least one reticle when viewed from the first vantage point; and a mounting element, the sighting element being connected to the mounting element, wherein the illuminating element is disposed at least partially within a portion of the mounting element, the mounting element having a window disposed between the illuminating element and the at least one reticle, the window permitting transmission of the light produced by the illuminating element therethrough.

9. The sighting device of claim 8, wherein the window comprises an aperture extending through a portion of the mounting element.

10. The sighting device of claim 8, wherein the window comprises a non-opaque material.

11. The sighting device of claim 1, wherein the second connection component comprises at least one mounting element adjustment mechanism adapted for altering the position of the mounting element relative to the base, the at least one mounting element adjustment mechanism comprising a vertical mounting element adjustment mechanism adapted for altering the vertical position of the mounting element relative to the base when viewed from the first vantage point; and/or a lateral mounting element adjustment mechanism adapted for altering the lateral position of the mounting element relative to the base when viewed from the first vantage point.

12. The sighting device of claim 1, wherein the base further comprises a third connection component for receiving an optic, the sighting device further comprising an optic connected to the base via the third connection component such that the at least one reticle is disposed at least partially between the optic and the illuminating element, the optic being optically aligned with the at least one reticle such that the optic visibly magnifies the at least one reticle when viewed from the first vantage point.

13. The sighting device of claim 12, wherein the optic comprises a non-opaque segmented optical component.

14. A backlit sighting device, comprising:

an illuminating element; and a sighting assembly, the sighting assembly comprising:

a mounting element, the illuminating element being disposed at least partially within a body portion of the mounting element; and a sighting element comprising a non-opaque body and at least one reticle disposed on or in the body such that the at least one reticle is visible when viewed from a first vantage point, the illuminating element being disposed behind the at least one reticle when viewed from the first vantage point such that light produced by the illuminating element passes through at least a portion of the body backlighting the at least one reticle when viewed from the first vantage point, the sighting element being connected to the mounting element, the mounting element having a window disposed between the illuminating element and the at least one reticle, the window permitting transmission of the light produced by the illuminating element therethrough.

15. A backlit sighting device, comprising:

a mounting element;

a sighting element attached to the mounting element, the sighting element comprising a non-opaque body and at least one reticle visibly disposed on or in the non-opaque body when viewed from a first vantage point; and an illuminating element disposed at least partially within a portion of the mounting element, the mounting element further comprising a window disposed between the illuminating element and the at least one reticle, the illuminating element being disposed behind the at least one reticle when viewed from the first vantage point such that light produced by the illuminating element passes through at least a portion of the non-opaque body thereby backlighting the at least one reticle when viewed from the first vantage point, the window permitting transmission of the light produced by the illuminating element therethrough.

16. The sighting device of claim 1, wherein the illuminating element is disposed directly behind and/or aligned with the at least one reticle when viewed from the first vantage point.

17. The sighting device of claim 1, wherein the sighting element and the mounting element are separate components connected to one another.

18. The sighting device of claim 8, wherein the illuminating element is disposed directly behind and/or aligned with the at least one reticle when viewed from the first vantage point.

19. The sighting device of claim 8, wherein the sighting element and the mounting element are separate components connected to one another.

20. The sighting device of claim 14, wherein the illuminating element is disposed directly behind and/or aligned with the at least one reticle when viewed from the first vantage point.

21. The sighting device of claim 14, wherein the sighting element and the mounting element are separate components connected to one another.

22. The sighting device of claim 14, wherein the window comprises a non-opaque material and/or an aperture extending through a portion of the mounting element.

23. The sighting device of claim 15, wherein the illuminating element is disposed directly behind and/or aligned with the at least one reticle when viewed from the first vantage point.

24. The sighting device of claim 15, wherein the sighting element and the mounting element are separate components connected to one another.

25. A backlit sighting device, comprising:

an illuminating element; and a sighting element comprising a non-opaque body and at least one reticle disposed on or in the body such that the at least one reticle is visible when viewed from a first vantage point, the illuminating element being disposed directly behind the at least one reticle when viewed from the first vantage point such that light produced by the illuminating element passes through at least a portion of the body backlighting the at least one reticle when viewed from the first vantage point.

26. The sighting device of claim 25, wherein the illuminating element is disposed at least partially within the body of the sighting element.

27. The sighting device of claim 25, wherein the sighting element and the mounting element are separate components connected to one another.

28. A backlit sighting device, comprising:

an illuminating element; and a sighting element comprising a non-opaque body and at least one reticle disposed on or in the body such that the at least one reticle is visible when viewed from a first vantage point, the illuminating element being disposed behind the at least one reticle when viewed from the first vantage point such that light produced by the illuminating element passes through at least a portion of the body backlighting the at least one reticle when viewed from the first vantage point, the illuminating element being visible through the body of the sighting element when viewed from the first vantage point.

29. A backlit sighting device, comprising:

an illuminating element;

a sighting element comprising a non-opaque body and at least one reticle disposed on or in the body such that the at least one reticle is visible when viewed from a first vantage point; and a magnifying optical component configured to magnify a view of the at least one reticle when viewed from the first vantage point, the sighting element being disposed between the optical component and the illuminating element when viewed from the first vantage point such that light produced by the illuminating element passes through at least a portion of the body backlighting the at least one reticle when the at least one reticle is viewed through the optical component from the first vantage point, the illuminating element being in line with the sighting element and the optical component when viewed from the first vantage point, the sighting element being in line with the illuminating element and the optical component when viewed from the first vantage point, and the optical component is in line with the sighting element and the illuminating element when viewed from the first vantage point.

30. The sighting device of claim 29, wherein the sighting device is an open sighting device, such that a view of an object positioned behind the sighting element and behind the illuminating element when viewed through the optical component from the first vantage point over a top of the sighting element is unobstructed by the sighting device.

31. The sighting device of claim 29, wherein the illuminating element is visible through the body of the sighting element when viewed from the first vantage point.

32. A backlit sighting device, comprising:

an illuminating element;

a sighting element comprising a non-opaque body and at least one reticle disposed on or in the body such that the at least one reticle is visible when viewed from a first vantage point, the illuminating element being disposed behind the at least one reticle when viewed from the first vantage point such that light produced by the illuminating element passes through at least a portion of the body backlighting the at least one reticle when viewed from the first vantage point; and a magnifying optical component, the sighting element being disposed between the optical component and the illuminating element when viewed from the first vantage point, the sighting device being an open sighting device.

33. The sighting device of claim 32, wherein a view of an object positioned behind the sighting element and behind the illuminating element when viewed through the optical component from the first vantage point over a top of the sighting element is unobstructed by the sighting device.

34. The sighting device of claim 32, wherein the illuminating element is visible through the body of the sighting element when viewed from the first vantage point.

* * * * *